US012158008B2

(12) United States Patent
Ochi

(10) Patent No.: US 12,158,008 B2
(45) Date of Patent: Dec. 3, 2024

(54) ARCHITECTURAL BRACKET, BUILDING WALL STRUCTURE, AND PLANK MEMBER CONSTRUCTION METHOD

(71) Applicant: NICHIHA CORPORATION, Nagoya (JP)

(72) Inventor: Yoshio Ochi, Nagoya (JP)

(73) Assignee: NICHIHA CORPORATION, Nagoya (JP)

( * ) Notice: Subject to any disclaimer, the term of this patent is extended or adjusted under 35 U.S.C. 154(b) by 113 days.

(21) Appl. No.: 17/598,808

(22) PCT Filed: Aug. 31, 2020

(86) PCT No.: PCT/JP2020/032875
§ 371 (c)(1),
(2) Date: Sep. 27, 2021

(87) PCT Pub. No.: WO2021/049352
PCT Pub. Date: Mar. 18, 2021

(65) Prior Publication Data

US 2022/0195735 A1 Jun. 23, 2022

(30) Foreign Application Priority Data

Sep. 12, 2019 (JP) ..... 2019-166636

(51) Int. Cl.
*E04F 13/08* (2006.01)
*E04B 1/38* (2006.01)
*E04B 2/58* (2006.01)

(52) U.S. Cl.
CPC ..... *E04F 13/0805* (2013.01); *E04B 1/388* (2023.08); *E04B 2/58* (2013.01); *E04B 2001/389* (2023.08)

(58) Field of Classification Search
CPC ..... E04B 1/388; E04B 2/58; E04B 2001/389; E04F 13/0805
(Continued)

(56) References Cited

U.S. PATENT DOCUMENTS 491,091 A * 2/1893 Drake ..... F22B 37/202 248/300
3,972,168 A * 8/1976 Allen ..... E04B 1/4114 52/713

(Continued)

FOREIGN PATENT DOCUMENTS

DE 8501840 U1 4/1985
DE 29920358 U1 2/2000

(Continued)

OTHER PUBLICATIONS

Extended European Search Report for EP Patent Application No. 20862973.3 dated Oct. 28, 2022 (9 sheets).

*Primary Examiner* — James J Buckle, Jr.
(74) *Attorney, Agent, or Firm* — Kratz, Quintos & Hanson, LLP

(57) ABSTRACT

Provided is an architectural bracket that has an improved strength, and is suitable for realizing a high degree of freedom in terms of the arrangement relationship with a fixation object in construction, as well as a building wall structure and a plank member construction method that use the architectural bracket. An architectural bracket X1 includes a first fixing portion 10 that includes a surface 11 for coming into contact with a building frame, and a second fixing portion 20 that extends from an end of the first fixing portion 10 to a side opposite to the surface 11, so as to intersects with the first fixing portion 10. The second fixing portion 20 includes a base portion 21 that includes a surface 21A, a rib portion 22, a first side-wall portion 23, and a second side-wall portion 24. The rib portion 22 protrudes (Continued)

from the base portion 21, and includes, at a protruding end thereof, a surface 22A. The first side-wall portion 23 protrudes from an end of the base portion 21 in the width direction W of the base portion 21 to the same side as the side to which the rib portion 22 protrudes. The second side-wall portion 24 protrudes from the other end of the base portion 21 in the width direction W to the same side as the side to which the rib portion 22 protrudes.

14 Claims, 25 Drawing Sheets

(58) Field of Classification Search
USPC ..... 52/506.06
See application file for complete search history.

(56) References Cited

U.S. PATENT DOCUMENTS

| | | | | | |
|---|---|---|---|---|---|
| 5,060,710 | A * | 10/1991 | Haarer | A47H 1/144 | 160/902 |
| 5,664,392 | A * | 9/1997 | Mucha | E04B 2/96 | 52/285.3 |
| 5,720,571 | A * | 2/1998 | Frobosilo | E04B 2/96 | 403/231 |
| 5,755,416 | A | 5/1998 | Leek | | |
| 5,846,018 | A * | 12/1998 | Frobosilo | F16B 5/0225 | 403/231 |
| 6,213,679 | B1 * | 4/2001 | Frobosilo | E04B 2/96 | 403/14 |
| 6,612,087 | B2 | 9/2003 | diGirolamo | | |
| 7,104,024 | B1 | 9/2006 | diGirolamo | | |
| 7,299,593 | B1 * | 11/2007 | diGirolamo | E04B 2/58 | 52/274 |
| 7,478,508 | B2 * | 1/2009 | Peterson | E04B 2/96 | 248/300 |
| 7,503,150 | B1 | 3/2009 | diGirolamo | | |
| 7,926,230 | B2 | 4/2011 | Yoshida | | |
| 8,511,032 | B2 * | 8/2013 | Abdel-Rahman | E04B 2/88 | 52/573.1 |
| 8,555,592 | B2 | 10/2013 | Daudet | | |
| D815,313 | S * | 4/2018 | Ralph | D25/199 | |
| D815,314 | S * | 4/2018 | Ralph | D25/199 | |
| D815,315 | S * | 4/2018 | Ralph | D25/199 | |
| D830,812 | S * | 10/2018 | Kanter | D8/354 | |
| 10,787,817 | B1 * | 9/2020 | Bilge | E04F 13/12 | |
| D904,171 | S | 12/2020 | Ochi | | |
| D906,788 | S | 1/2021 | Ochi | | |
| 11,692,340 | B2 * | 7/2023 | Stahl | E04B 1/2403 | 52/506.01 |
| 11,719,269 | B2 * | 8/2023 | Chang | F16B 12/50 | 403/403 |
| 11,750,143 | B1 * | 9/2023 | Jasmin | H02S 30/10 | 248/237 |
| 2001/0045075 | A1 | 11/2001 | Watanabe | | |
| 2002/0124514 | A1 | 9/2002 | Higgins | | |
| 2008/0296451 | A1 * | 12/2008 | Yoshida | E04F 13/0808 | 248/220.1 |
| 2015/0308098 | A1 * | 10/2015 | Tessadori | E04B 2/7411 | 52/698 |

FOREIGN PATENT DOCUMENTS

| | | | |
|---|---|---|---|
| DE | 202011100168 | U1 | 8/2012 |
| EP | 0008272 | A1 | 2/1980 |
| EP | 2108757 | A1 | 10/2009 |
| EP | 2309072 | A1 | 4/2011 |
| FR | 3012489 | A1 | 5/2015 |
| JP | S53-022972 | Y2 | 6/1978 |
| JP | H06-22038 | Y2 | 6/1994 |
| JP | H09-032167 | A | 2/1997 |
| JP | H10-205100 | A | 8/1998 |
| JP | H11-324157 | A | 11/1999 |
| JP | 2000-336768 | A | 12/2000 |
| JP | 2002-038631 | A | 2/2002 |
| JP | 2002-339473 | A | 11/2002 |
| JP | 1164014 | S | 1/2003 |
| JP | 2004-150189 | A | 5/2004 |
| JP | 1213966 | S | 8/2004 |
| JP | 2005-023746 | A | 1/2005 |
| JP | 2005-171752 | A | 6/2005 |
| JP | 2006-52582 | A | 2/2006 |
| JP | 1262321 | S | 2/2006 |
| JP | 2007-211511 | A | 8/2007 |
| JP | 3137086 | U | 11/2007 |
| JP | 2007-321510 | A | 12/2007 |
| JP | 1330668 | S | 5/2008 |
| JP | 2009-035896 | A | 2/2009 |
| JP | 1372319 | S | 11/2009 |
| JP | 1374237 | S | 11/2009 |
| JP | 1387698 | S | 5/2010 |
| JP | 2010-255234 | A | 11/2010 |
| JP | 1443445 | S | 6/2012 |
| JP | 1452657 | S | 10/2012 |
| JP | 1466068 | S | 4/2013 |
| JP | 1469363 | S | 5/2013 |
| JP | 1478151 | S | 9/2013 |
| JP | 1478152 | S | 9/2013 |
| JP | 1490219 | S | 2/2014 |
| JP | 2015-169041 | A | 9/2015 |
| JP | 1551096 | S | 6/2016 |
| JP | 1568631 | S | 2/2017 |
| JP | 1586221 | S | 9/2017 |
| JP | 2017-227262 | A | 12/2017 |
| JP | 1598491 | S | 2/2018 |
| JP | 2018-066151 | A | 4/2018 |
| JP | 1613767 | S | 9/2018 |
| JP | 2019-007327 | A | 1/2019 |
| KR | 20-2000-0012920 | U | 7/2000 |
| WO | 96/31667 | A1 | 10/1996 |
| WO | 2005/090706 | A1 | 9/2005 |

* cited by examiner

ARCHITECTURAL BRACKET, BUILDING WALL STRUCTURE, AND PLANK MEMBER CONSTRUCTION METHOD

TECHNICAL FIELD

The present invention relates to an architectural bracket that can be used for construction of a wall structure of a building, as well as a building wall structure and a plank member construction method that use the architectural bracket.

BACKGROUND ART

For construction of a wall structure of a building, various types of fixing and connecting tools are used to vertically and horizontally connect a plurality of plank members for constituting a wall surface to each other, and to form a wall structure on a skeleton structure. There are cases where, as an example of such fixing and connecting tools, brackets (architectural brackets) are used for fixing, e.g., furring strips to which plank members constituting a wall surface are fixed and that support the plank members, to a skeleton structure. Techniques relating to such architectural brackets are disclosed in, for example, Patent Documents 1 and 2 below.

CITATION LIST

Patent Documents

Patent Document 1: JP 2019-7327A
Patent Document 2: JP 2015-169041A

SUMMARY OF INVENTION

Technical Problem

Architectural brackets are required to have a strength such that they can endure operations for constructing a wall structure, and a strength such that they continuously hold the constructed wall structure. On the other hand, depending on the type of building structure such as steel construction (S construction), there are limitations to the positions at which architectural brackets can be arranged when constructing a wall structure, and there are also limitations to the positions at which fixation objects such as furring strips to be fixed to and supported by architectural brackets can be arranged. Therefore, conventional brackets can sometimes not be used for construction of a predetermined wall structure, depending on the structure of the brackets.

The present invention was made in view of such circumstances, and an object thereof is to provide an architectural bracket that has an improved strength, and is suitable for realizing a high degree of freedom in terms of the arrangement relationship with a fixation object in construction, as well as a building wall structure and a plank member construction method that use the architectural bracket.

Solution to Problem

According to a first aspect of the present invention, an architectural bracket is provided. This architectural bracket includes a first fixing portion and a second fixing portion. The first fixing portion includes a first surface for coming into contact with a building frame. The second fixing portion includes a base portion, a rib portion, a first side-wall portion, and a second side-wall portion.

The second fixing portion extends from an end of the first fixing portion to the side opposite to the first surface so as to intersect with the first fixing portion, and includes a second surface for coming into contact with a member. The rib portion protrudes from the base portion to a side opposite to the second surface, and includes, at a protruding end of the rib portion, a third surface for coming into contact with a member. The first side-wall portion protrudes from an end of the base portion in a width direction that intersects with a direction in which the second fixing portion extends, to the same side as the side to which the rib portion protrudes, and includes a first wall portion for coming into contact with a member arranged in parallel to the rib portion in the width direction. The second side-wall portion protrudes from the other end of the base portion in the width direction of the base portion, to the same side as the side to which the rib portion protrudes, and includes a second wall portion for coming into contact with a member arranged in parallel to the rib portion in the width direction.

Such an architectural bracket is used when constructing a wall structure in the following manner.

First, the first surface of the first fixing portion of the architectural bracket is brought into contact with a predetermined wall surface of a skeleton structure, and in this state, the architectural bracket and the wall surface are fastened to each other by a fastening member that is passed through the first fixing portion from a side opposite to the first surface and reaches the wall surface. For example, a plurality of architectural brackets are secured to the wall surface of the skeleton structure in a predetermined arrangement.

Then, in a state in which a fixation object (member) spans, for example, at least two architectural brackets secured to the wall surface, the fixation object is fixed to the architectural brackets (bracket fixating operation). The fixation object refers to a supporting member to which plank members for constituting a wall portion are fixed and that supports the plank members, and is, for example, a furring strip. The furring strip may be a so-called vertical furring strip, or a lateral furring strip.

In the bracket fixating operation, specifically, the fixation object is brought into contact with the second surfaces of the base portions of the second fixing portions of the architectural brackets, and in this state, the architectural brackets and the fixation object are fastened and fixed to each other by fastening members that are passed through the base portions from a side opposite to the second surfaces and reach the fixation object. Alternatively, the fixation object is brought into contact with the third surfaces of the rib portions of the second fixing portions of the architectural brackets, as well as the first wall portions and the second wall portions, and in this state, the architectural brackets and the fixation object are fastened and fixed to each other by fastening members that are passed through the rib portions from a side opposite to the third surfaces and reach the fixation object.

In the architectural brackets used in this manner for example, as described above, the second fixing portion to be fastened to the fixation object includes, in the base portion thereof, the rib portion, and includes the first side-wall portion and the second side-wall portion that protrude from the base portion to the same side as the side to which the rib portion protrudes. Such a configuration is suitable for improving the strength of the architectural bracket in terms of being able to endure wall structure construction operations including so-called unevenness adjustment and so on, and the strength to continuously hold the constructed wall structure.

Also, the second fixing portion of the architectural bracket that is to be fastened to a fixation object includes, as surfaces for coming into contact with a member, the second surface and the third surface opposite to the second surface. Such a configuration is suitable for realizing a high degree of freedom in terms of the arrangement relationship between the architectural bracket and the fixation object when constructing a wall structure. That is to say, this architectural bracket can be used in various orientations and mounting aspects.

As described above, the architectural bracket according to the first aspect of the present invention is suitable for improving its strength and realizing a high degree of freedom in terms of the arrangement relationship with a fixation object in construction. The improvement in the strength of the architectural bracket is suitable for preventing the architectural bracket from deforming in a building wall structure in which the architectural bracket is used, and thus is suitable for stably supporting a fixation object fixed by the architectural bracket and another member, such as a plank member for constituting a wall portion, that is fixed to this fixation object. Also, when a high degree of freedom regarding the above-described arrangement relationship is realized, it is suitable to use the architectural bracket in construction of various types of wall structures in various types of building construction such as steel construction (S construction) and reinforced concrete construction (RC construction).

Also, in the architectural bracket, the above-described configuration in which the first wall portion of the first side-wall portion, the second wall portion of the second side-wall portion, and the rib portion interposed therebetween protrude to the same side from the base portion and are arranged in parallel to each other makes the second fixing portion likely to come into contact with a fixation object at three positions, when the fixation object is arranged on the third surface side of the second fixing portion and is fastened to the second fixing portion. The configuration in which the second fixing portion comes into contact with a fixation object at three positions is suitable for the second fixing portion, that is, the architectural bracket to stably support a fixation object or another member, such as a plank member for constituting a wall surface, that is fixed to this fixation object.

Preferably, the protrusion heights of the third surface, the first wall portion, and the second wall portion from the base portion are equal to each other. Such a configuration is suitable when the second fixing portion comes into contact with a fixation object at three positions, in a case where the fixation object is arranged on the third surface side of the second fixing portion and is fastened to the second fixing portion, and thus is suitable for the second fixing portion, that is, the architectural bracket to stably support the fixation object or another member, such as a plank member for constituting a wall surface, that is fixed to the fixation object.

Preferably, the first fixing portion includes: a third side-wall portion that protrudes from an end of the first fixing portion in the width direction, to the same side as the side to which the second fixing portion protrudes; and a fourth side-wall portion that protrudes from the other end of the first fixing portion in the width direction, to the same side as the side to which the second fixing portion protrudes. In this case, more preferably the first side-wall portion of the second fixing portion and the third side-wall portion of the first fixing portion are connected to each other, and the second side-wall portion of the second fixing portion and the fourth side-wall portion of the first fixing portion are connected to each other. Such a configuration is suitable in terms of improving the strength of the architectural bracket.

Preferably, the first side-wall portion includes, on the first fixing portion side relative to the first wall portion, a first high wall portion that is higher than the first wall portion, and the second side-wall portion includes, on the first fixing portion side relative to the second wall portion, a second high wall portion that is higher than the second wall portion. Such a configuration is suitable in terms of improving the strength of the architectural bracket.

Preferably, the base portion of the second fixing portion has at least one hole through which a fastening member is to be passed. Preferably, the hole includes an elongated hole that extends in the direction in which the second fixing portion extends. Preferably, the rib portion has at least one hole through which a fastening member is to be passed. Preferably, the hole includes an elongated hole that extends in the direction in which the second fixing portion extends. Preferably, the first fixing portion has at least one hole through which a fastening member is to be passed. Preferably, the hole includes a first hole, and at least one second hole that is located in a surrounding area of the first hole and is smaller than the first hole. Such configurations are suitable for eliminating or avoiding an operation for forming, in the architectural bracket, a hole through which a fastening member is to be passed when constructing a wall structure using the architectural bracket, thereby achieving simplified and efficient construction operations.

Preferably, a surface of the first fixing portion that is opposite to the first surface has a reference line for use in positioning. Such a configuration is useful in positioning the architectural bracket when constructing a wall structure using the architectural bracket.

According to a second aspect of the present invention, a building wall structure is provided. This building wall structure includes: a building frame that includes a wall surface; a plurality of architectural brackets arranged on the wall surface; a plurality of supporting members each arranged extending across at least two architectural brackets; a plurality of first fastening members; a plurality of second fastening members; and a plurality of plank members for covering the wall surface.

Each of the architectural brackets is the above-described architectural bracket according to the first aspect of the present invention. In the building wall structure, the first surfaces of the first fixing portions of the architectural brackets are in contact with the wall surface, and the architectural brackets and the wall surface are fastened to each other by the first fastening members that are passed through the first fixing portions from a side opposite to the first surfaces and reach the wall surface. Each of the supporting members includes a first joining portion that is fixed to the architectural brackets, and a second joining portion that is connected to a side of the first joining portion that is opposite to the wall surface. Also, the plank members are directly or indirectly secured to the second joining portions of the supporting members.

At at least one of a plurality of fixation positions at which the plurality of supporting members are fixed to the plurality of architectural brackets, either of a first fixation aspect and a second fixation aspect that will be described below is realized.

In the first fixation aspect, the first joining portion of the supporting member is in contact with the second surfaces of the base portions of the second fixing portions of the architectural brackets, and the architectural brackets and the supporting member are fastened to each other by the second fastening members that are passed through the base portions from a side opposite to the second surfaces and reach the first joining portion. In the second fixation aspect, the first joining portion of the supporting member is in contact with the third surfaces of the rib portions of the second fixing portions of the architectural brackets, as well as the first wall portions and the second wall portions, and the architectural brackets and the supporting member are fastened to each other by the second fastening members that are passed through the rib portions from a side opposite to the third surfaces and reach the first joining portion.

In the building wall structure, the architectural brackets according to the first aspect of the present invention are used. According to the building wall structure, thus, the architectural brackets included in the building wall structure achieve the same technical effects as those described regarding the architectural bracket according to the first aspect of the present invention.

Of the securing aspects of securing the plank members to the supporting members, the configuration in which "the plank members are directly secured to the second joining portions of the supporting members" specifically refers to a configuration in which the plank members are coupled to the second joining portions without using supporting members other than the supporting members, and are directly secured to the supporting members by fastening members or securing members such as screws. According to such a configuration, no other supporting members than the supporting members are used as elements for directly securing the plank members, making it possible to reduce the number of constituent components, and simplify the operations due to the reduction in the number of operational steps.

On the other hand, of the securing aspects of securing the plank members to the supporting members, the configuration in which "the plank members are indirectly secured to the second joining portions of the supporting members" specifically refers to a configuration in which the plank members are coupled to the second joining portion via supporting members (second supporting members, for example, later-described additional supporting members) other than the supporting members (first supporting member), and the second supporting members are secured to the first supporting members by fastening members such as screws, and the plank members are further secured to the second supporting members by fastening members or securing members such as screws. At least one second supporting member is provided. With such a configuration, using the second supporting member different from the first supporting member, it is possible to favorably performing unevenness adjustment of the wall surface, and more stably support the plank members.

According to the above-described second aspect of the present invention, preferably, the building wall structure further includes an extension member and a third fastening member as follows.

The extension member includes an extension base portion, a first extension side-wall portion, and a second extension side-wall portion. The extension base portion includes a fourth surface for coming into contact with the second surface or the third surface of the base portion of the architectural bracket, and a fifth surface for coming into contact with a member located opposite to the fourth surface, the extension base portion extending along the base portion. The first extension side-wall portion protrudes from an end of the extension base portion in a width direction that intersects with an extension direction in which the extension base portion extends, to the fourth surface side in a thickness direction of the extension base portion. The second extension side-wall portion protrudes from the other end of the extension base portion in the width direction that intersects with the extension direction of the extension base portion, to the same side as the side to which the first extension side-wall portion protrudes.

The second fixing portion of the architectural bracket is fit between the first extension side-wall portion and the second extension side-wall portion of the extension member, and the extension member extends further to a side opposite to the first fixing portion relative to the second fixing portion of the architectural bracket in the extension direction in which the second fixing portion extends and the extension direction in which the extension base portion extends.

At a fixation position at which the supporting member is fixed to the architectural bracket, either of a first fastening aspect and a second fastening aspect that will be described below is realized.

In the first fastening aspect, the fourth surface of the extension member is in contact with the second surface of the base portion of the second fixing portion of the architectural bracket, and the architectural bracket and the supporting member are fastened to each other by the third fastening member that is passed through the base portion from a side opposite to the second surface and reaches the extension base portion, and the first joining portion of the supporting member is in contact with the fifth surface of the extension member, and the extension member and the supporting member are fastened to each other by the second fastening member that is passed through the extension member from the fourth surface side and reaches the first joining portion.

In the second fastening aspect, the fourth surface of the extension member is in contact with the third surface of the rib portion of the second fixing portion of the architectural bracket, and the architectural bracket and the extension member are fastened to each other by the third fastening member that is passed through the rib portion from a side opposite to the third surface and reaches the extension base portion, and the first joining portion of the supporting member is in contact with the fifth surface of the extension member, and the extension member and the supporting member are fastened to each other by the second fastening member that is passed through the extension member from the fourth surface side and reaches the first joining portion.

The above-described extension member is suitable for use in unevenness adjustment of the supporting member. In addition to this, the above-described architectural bracket and the extension member that cooperate with each other when connecting the skeleton structure and the supporting member are suitable for improving their strengths in a building wall structure, and realizing a high degree of freedom in terms of the arrangement relationship with the supporting member.

Preferably, the extension base portion includes: at least one elongated hole through which a fastening member is to be passed, and that extends in the extension direction of the extension base portion; and at least one hole through which a fastening member is to be passed, and that is spaced apart from the elongated hole in the width direction. Such a configuration is suitable for eliminating or avoiding an operation for forming, in the extension member Y, a hole through which a fastening member is to be passed when constructing a building wall structure, thereby achieving simplified and efficient construction operations.

Preferably, the building wall structure further includes a plurality of additional supporting members each arranged extending across at least two supporting members. The additional supporting members are secured to the second joining portions of the at least two supporting members, and the plank members are secured to the additional supporting members. Such a configuration is suitable for a case where a plurality of additional supporting members are arranged at a pitch different from the pitch at which the architectural brackets are arranged (pitch smaller than the latter), and the plank members are secured to the additional supporting members, and is thus suitable for supporting more stably the plank members.

According to a third aspect of the present invention, a plank member construction method is provided for securing a plank member to a building frame including a wall surface. The plank member construction method includes a first process, a second process, and a third process.

In the first process, a plurality of architectural brackets are secured to the wall surface. Each of the architectural brackets is the above-described architectural bracket according to the first aspect of the present invention. In the first process, the first surfaces of the first fixing portions of the architectural brackets are brought into contact with the wall surface, and the architectural brackets and the wall surface are fastened to each other by the first fastening members that are passed through the first fixing portions from a side opposite to the first surfaces and reach the wall surface.

In the second process, a supporting member is fixed to at least two architectural brackets secured on the wall surface. The supporting member includes a first joining portion that is fixed to the architectural brackets, and a second joining portion that is connected to a side of the first joining portion that is opposite to the wall surface.

In the second process, specifically, the first joining portion of the supporting member is brought into contact with the second surfaces of the base portions of the second fixing portions of the architectural brackets, and the architectural brackets and the supporting member are fastened to each other by the second fastening members that are passed through the base portions from the side opposite to the second surfaces and reach the first joining portion. Alternatively, in the second process, the first joining portion of the supporting member is in contact with the third surfaces of the rib portions of the second fixing portions of the architectural brackets, as well as the first wall portions and the second wall portions, and the architectural brackets and the supporting member are fastened to each other by the second fastening members that are passed through the rib portions from a side opposite to the third surfaces and reach the first joining portion.

Also, in the third process, the plank member is directly or indirectly secured to the supporting member.

In the plank member construction method, the architectural brackets according to the first aspect of the present invention are used. According to the plank member construction method, thus, the architectural brackets used in this method achieve the same technical effects as those described regarding the bracket X according to the first aspect of the present invention.

DESCRIPTION OF EMBODIMENTS

Figure 1:
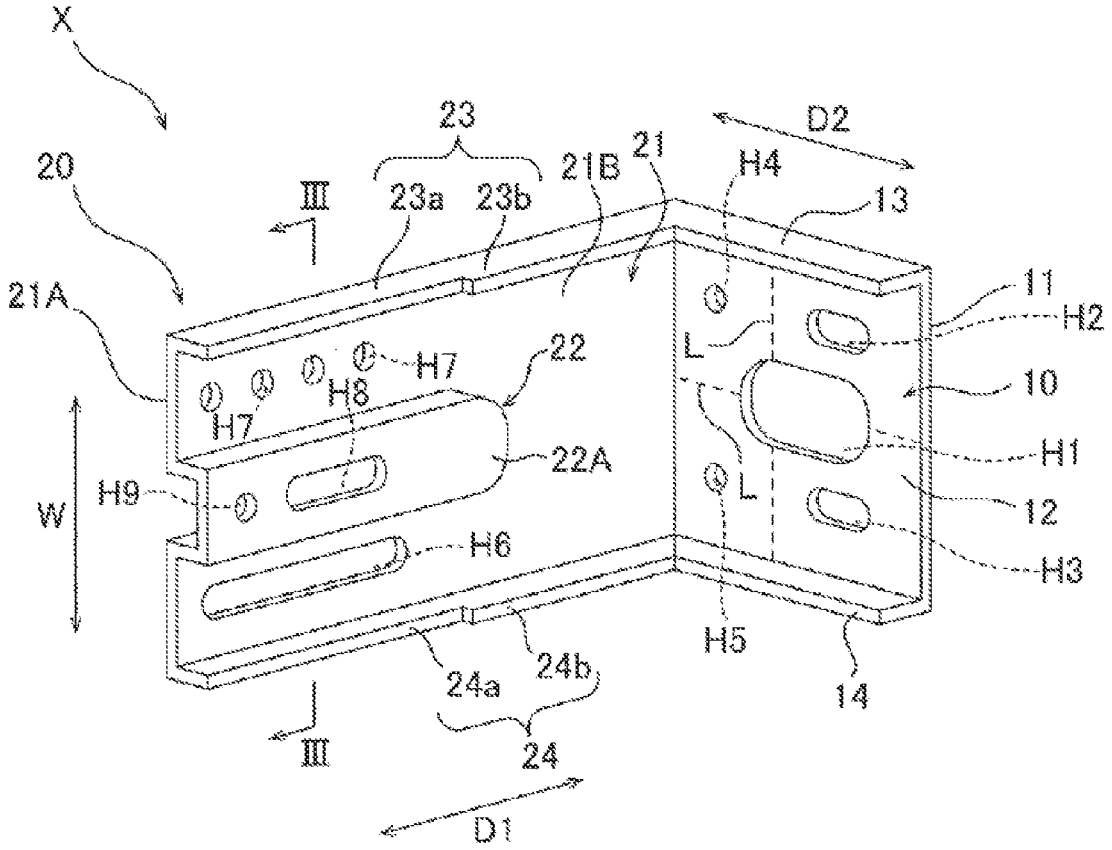
FIG. 1 is a perspective view illustrating an architectural bracket according to a first embodiment of the present invention.
Figure 2:
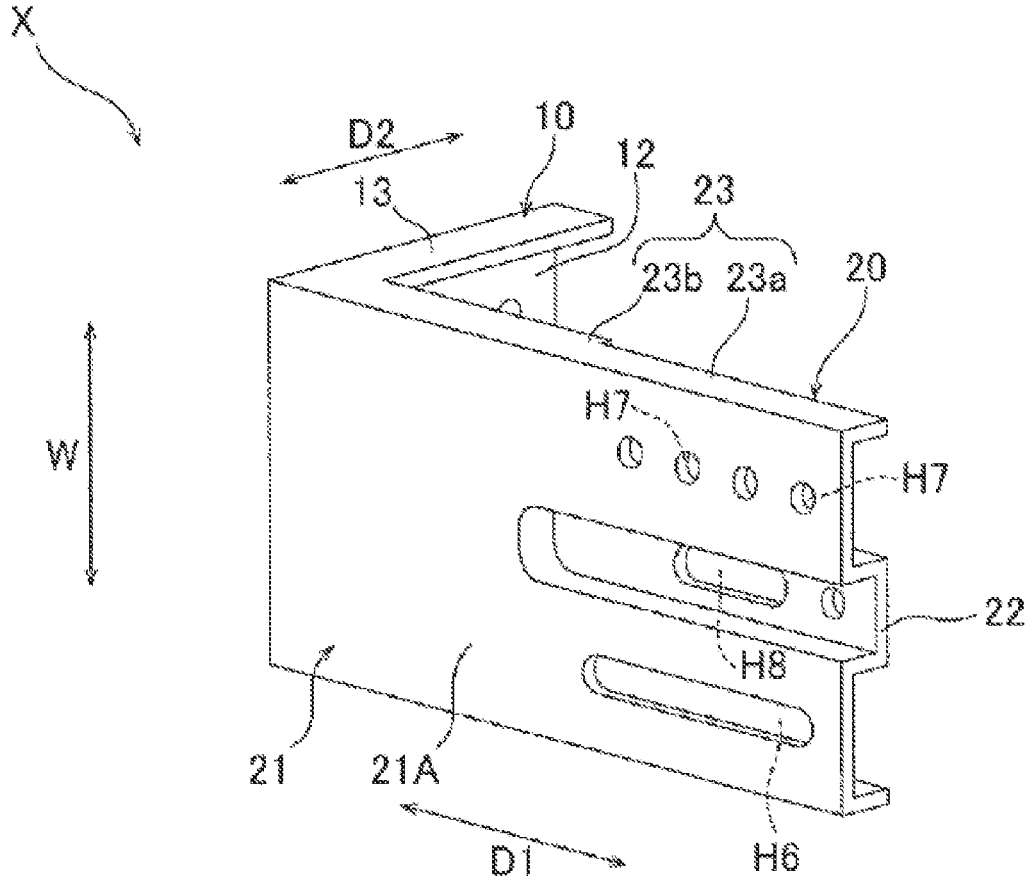
FIG. 2 is another perspective view illustrating the architectural bracket according to the first embodiment of the present invention.
Figure 3:
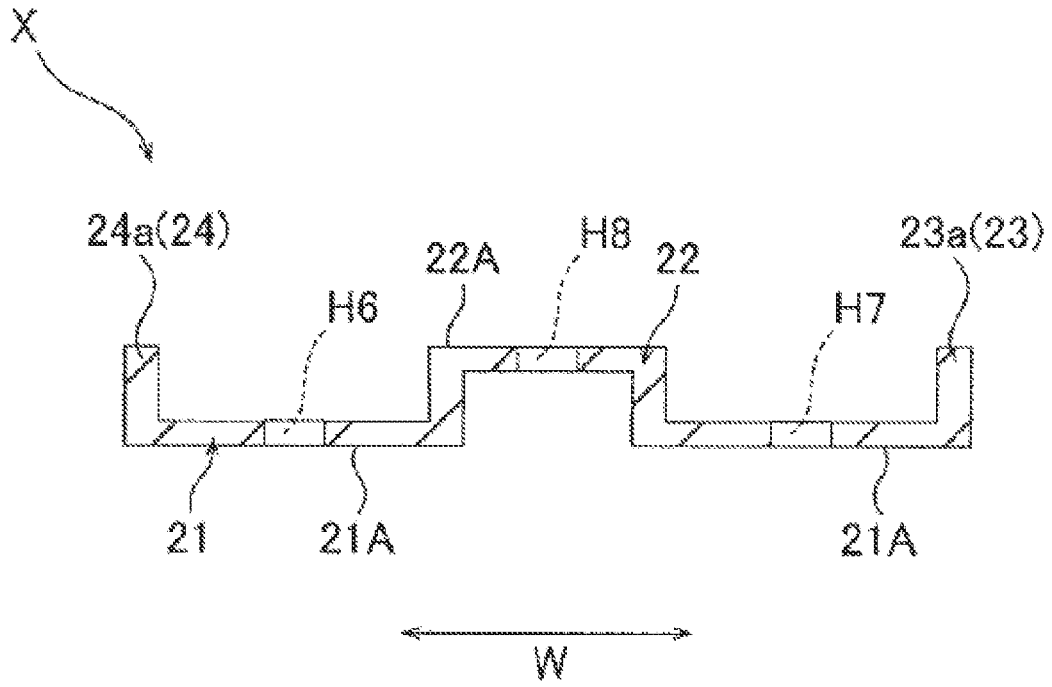
FIG. 3 is a cross-sectional view taken along III-III of the architectural bracket shown in FIG. 1.

FIGS. 1 to 3 show a bracket X according to a first embodiment of the present invention. FIG. 1 is a perspective view of the bracket X. FIG. 2 is another perspective view of the bracket X. FIG. 3 is a cross-sectional view taken along III-III of the bracket X shown in FIG. 1.

The bracket X includes a first fixing portion 10 and a second fixing portion 20. The bracket X is, for example, an architectural bracket for use in construction of a wall structure of a building, and is an element for fixing a furring strip or the like to which a plank member for constituting a wall portion of the wall structure to be formed is fixed and that supports this plank member, to a skeleton structure.

The first fixing portion 10 of the bracket X has a shape extending from an end, in one direction (first direction D1), of the second fixing portion 20 that extends in the first direction D1, in another direction (second direction D2). Although, in the present embodiment, the first direction D1 and the second direction D2 are orthogonal to each other, it is sufficient that the first direction D1 and the second direction D2 intersect with each other. Also, in the present embodiment, the first fixing portion 10 and the second fixing portion 20 of the bracket X have a width in a direction (width direction W) that is orthogonal to the first direction D1 and is orthogonal to the second direction D2 (it is sufficient that the width direction W intersects with the first direction D1 and the second direction D2). The dimension of the first fixing portion 10 in the second direction D2 is, for example, 30 to 70 mm. The dimension of the second fixing portion 20 in the first direction D1 is, for example, 70 to 140 mm. The width of the bracket X, that is, the width of the first fixing portion 10 and the second fixing portion 20 (dimension in width direction W) is, for example, 30 to 70 mm.

The first fixing portion 10 includes a surface 11 (first surface) for coming into contact with a building frame, the surface 11 being located opposite to the second fixing portion 20. A surface 12 of the first fixing portion 10 that is opposite to the surface 11 is provided with reference lines L (including a reference line extending in the second direction D2 and a reference line extending in the width direction W) for use in positioning. In the present embodiment, for example, the reference lines L are carved in the surface 12. Instead of such a structure, the reference lines L may be printed on the surface 12.

Also, the first fixing portion 10 includes a third side-wall portion 13 and a fourth side-wall portion 14. The third side-wall portion 13 protrudes from an end of the first fixing portion 10 in the width direction W toward the second fixing portion 20. The fourth side-wall portion 14 protrudes from the other end of the first fixing portion 10 in the width direction W toward the second fixing portion 20. In the first fixing portion 10, the protrusion heights of the third side-wall portion 13 and the fourth side-wall portion 14 from the surface 12 are each between 6 and 15 mm, for example.

In the present embodiment, the first fixing portion 10 has holes H1 to H5 through which a fastening member is to be passed. The holes H4 and H5 are smaller than the hole H1. The hole H1 is an elongated hole extending in the second direction D2. The dimension of the hole H1 in the second direction D2 is, for example, 15 to 45 mm, and the dimension of the hole H1 in the width direction W is, for example, 7 to 18 mm.

The hole H2 is an elongated hole extending in the second direction D2, and is spaced apart from the hole H1 in the width direction W. The dimension of the hole H2 in the second direction D2 is, for example, 7 to 17 mm, and the dimension of the hole H2 in the width direction W is, for example, 3 to 7 mm. The hole H3 is an elongated hole extending in the second direction D2, and is spaced apart from the hole H1 to the side opposite to the hole H2 in the width direction W. The dimension of the hole H3 in the second direction D2 is, for example, 7 to 17 mm, and the dimension of the hole H3 in the width direction W is, for example, 3 to 7 mm.

The hole H4 is a circular hole, and is spaced apart from the hole H2 in the second direction D2 while overlapping the hole H2 in terms of the formation position in the width direction W. The diameter of the hole H4 is, for example, 3 to 7 mm. The hole H5 is a circular hole, and is spaced apart from the hole H3 in the second direction D2 while overlapping the hole H3 in terms of the formation position in the width direction W. The diameter of the hole H5 is, for example, 3 to 7 mm. These configurations are exemplary. In the width direction W, the hole H4 and the hole H2 may be offset, and the hole H5 and the hole H3 may be offset. Also, in the second direction D2, the hole H4 and the hole H2 may be replaced in terms of the formation position, and the hole H5 and the hole H3 may be replaced in terms of the formation position.

The second fixing portion 20 of the bracket X includes a base portion 21, a rib portion 22, a first side-wall portion 23, and a second side-wall portion 24.

The second fixing portion extends from an end of the first fixing portion to the side opposite to the first surface so as to intersect with the first fixing portion. The base portion 21 includes a surface 21A (second surface) for coming into contact with a member, and a surface 21B located opposite to the surface 21A. The surface 21A is located on a side, in the second direction D2, that is opposite to the first fixing portion 10 extending from the second fixing portion 20.

In the present embodiment, the base portion 21 has a hole H6 through which a fastening member is to be passed, and four holes H7 lined up in the first direction D1. The hole H6 is an elongated hole extending in the first direction D1. The dimension of the hole H6 in the first direction D1 is, for example, 15 to 100 mm, and the dimension of the hole H6 in the width direction W is, for example, 3 to 7 mm. The holes H7 are circular holes, and are spaced apart from the hole H6 in the width direction W. The diameter of the holes H7 is, for example, 3 to 7 mm. The number of holes H7 in the base portion 21 is four in the present embodiment as described above, but may be less than four or more than four. Also, with respect to the arrangement of the holes H6 and H7 formed so that the rib portion 22 is interposed between the hole H6 and the holes H7, the position at which the hole H6 is formed and the positions at which the holes H7 are formed may be inverted with respect to those shown in FIG. 2.

The rib portion 22 protrudes from the base portion 21 to the side opposite to the surface 21A (to the surface 21B side), and includes, at a protruding end thereof, a surface 22A (third surface) for coming into contact with a member. The dimension of the rib portion 22 in the first direction D1 is, for example, 30 to 140 mm. The dimension of the rib portion 22 in the width direction W is, for example, 8 to 30 mm. Also, the protrusion height of the rib portion 22 from the base portion 21 is, for example, 5 to 12 mm.

In the present embodiment, the rib portion 22 has holes H8 and H9 through which a fastening member is to be passed. The hole H8 is an elongated hole extending in the first direction D1. The dimension of the hole H8 in the first direction D1 is, for example, 15 to 100 mm, and the dimension of the hole H8 in the width direction W is, for example, 3 to 7 mm. The hole H9 is a circular hole, and is spaced apart from the hole H8 in the first direction D1. The diameter of the hole H9 is, for example, 3 to 7 mm. A larger number of holes H9 than the number shown may be formed in the rib portion 22.

The first side-wall portion 23 protrudes from an end of the base portion 21 in the width direction W (that is, the direction that is orthogonal to the first direction D1 in which the second fixing portion 20 extends) to the same side as the side to which the rib portion 22 protrudes. The first side-wall portion 23 includes a first wall portion 23*a* for coming into contact with a member located parallel to the rib portion 22 in the width direction W. In the present embodiment, the first side-wall portion 23 includes, on the first fixing portion 10 side relative to the first wall portion 23*a*, a first high wall portion 23*b* that is higher than the first wall portion 23*a*. Also, in the present embodiment, the first side-wall portion 23 of the second fixing portion 20 and the above-described third side-wall portion 13 of the first fixing portion 10 are connected to each other at an end of the bracket X in the width direction W The second side-wall portion 24 protrudes from the other end of the base portion 21 in the width direction W to the same side as that to which the rib portion 22 protrudes. The second side-wall portion 24 includes a second wall portion 24*a* for coming into contact with a member located parallel to the rib portion 22 in the width direction W. In the present embodiment, the second side-wall portion 24 includes, on the first fixing portion 10 side relative to the second wall portion 24*a*, a second high wall portion 24*b* that is higher than the second wall portion 24*a*. Also, in the present embodiment, the second side-wall portion 24 of the second fixing portion 20 and the above-described fourth side-wall portion 14 of the first fixing portion 10 are connected to each other at the other end of the bracket X in the width direction W.

The protrusion heights of the first wall portion 23*a* and the second wall portion 24*a* of the first side-wall portion 23 and the second side-wall portion 24 from the base portion 21 are equal to the protrusion height of the rib portion 22, and is 5 to 12 mm, for example. The protrusion height of the first high wall portion 23*b* from the base portion 21 has a value between 6 to 15 mm, for example, as long as it is greater than the protrusion height of the first high wall portion 23*a*. The protrusion height of the second high wall portion 24*b* from the base portion 21 has a value between 6 to 15 mm, for example, as long as it is greater than the protrusion height of the second high wall portion 24*a*.

The bracket X having the above-described configuration can be manufactured by performing punching, bending, and pressing on a metal plate such as a steel plate, for example. The thickness of a metal plate that is used to manufacture the bracket X is, for example, 1 to 5 mm.

Figure 4:
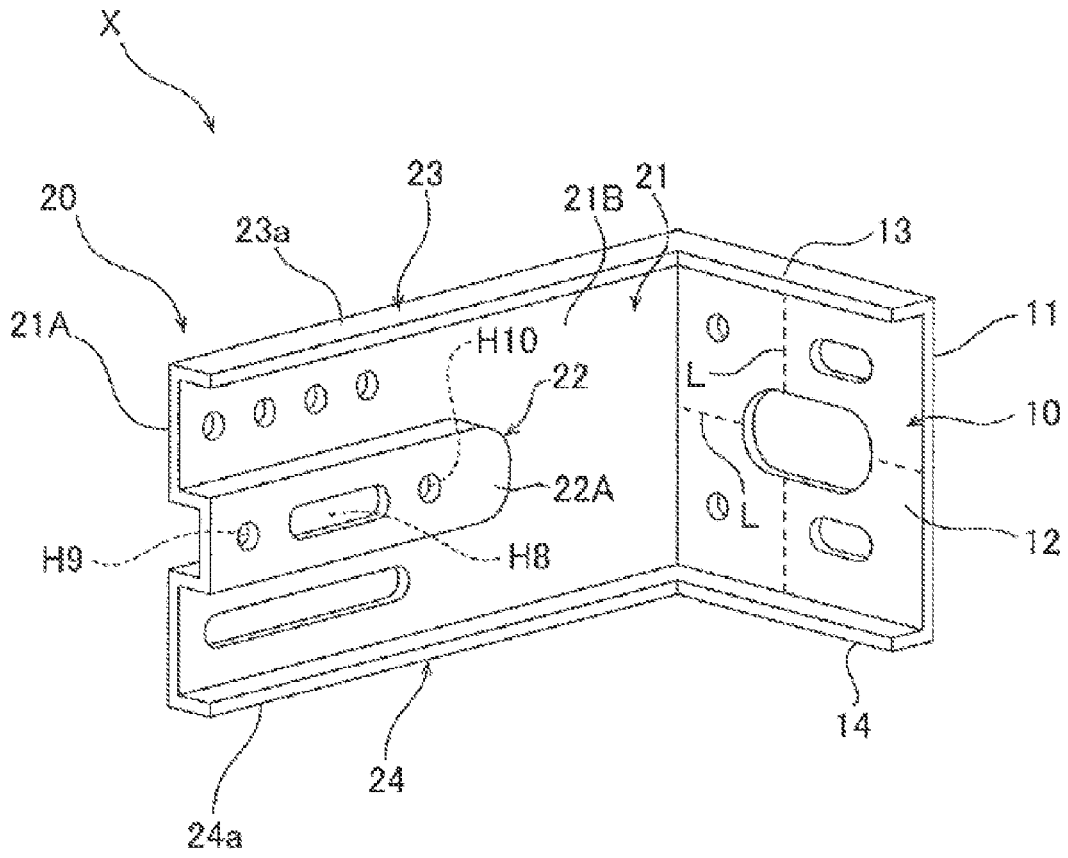
FIG. 4 is a perspective view illustrating a modification of the architectural bracket shown in FIG. 1.

As shown in FIG. 4, the bracket X may have a configuration in which the first side-wall portion 23 and the second side-wall portion 24 do not include the first high wall portion 23*b* and the second high wall portion 24*b*.

As shown in FIG. 4, the bracket X may also include, in addition to the holes H8 and H9, a hole H10 in the rib portion 22. The hole H10 is a circular hole, and is spaced apart from the hole H8 to the side opposite to the hole H9 in the first direction D1. The diameter of the hole H10 is, for example, 3 to 7 mm.

The bracket X may also have, in the surface 12 of the first fixing portion 10, the reference lines L at positions different from those in FIG. 1. For example, the reference line L of the surface 12 of the first fixing portion 10 of the bracket X shown in FIG. 4 that extends in the vertical direction in the FIG. 4 is located on the right side of the FIG. 4 relative to the reference line L on the surface 12 of the first fixing portion 10 of the bracket X shown in FIG. 1 that extends in the vertical direction in the FIG. 1.

Figure 5:
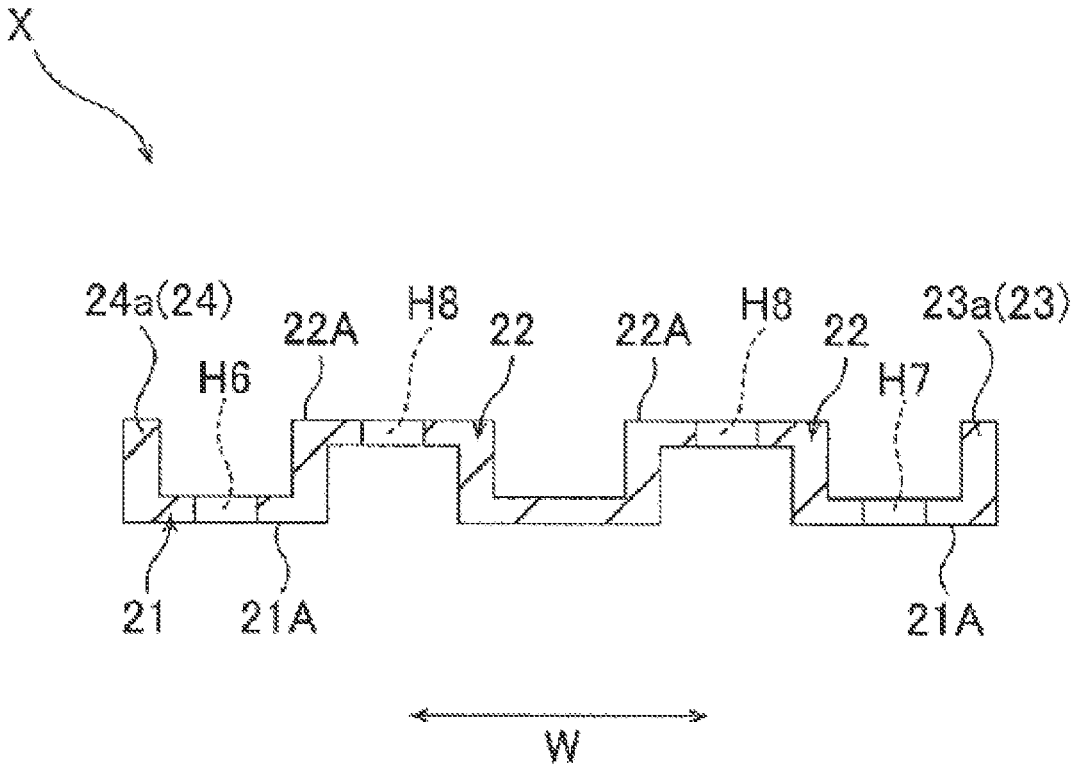
FIG. 5 is a cross-sectional view illustrating another modification of the architectural bracket shown in FIG. 1, the cross-sectional view illustrating a portion that corresponds to the cross-sectional view shown in FIG. 3 of the architectural bracket shown in FIG. 1.

In the bracket X, as shown in FIG. 5, the second fixing portion 20 may include two rib portions 22 of the above-described type that extend in the first direction D1 (FIG. 5 is a cross-sectional view showing a portion that corresponds to the cross-sectional view shown in FIG. 3 of the bracket X shown in FIG. 1). In this case, the protrusion height of the two rib portions 22 from the base portion 21, and the protrusion heights of the first wall portion 23*a* and the second wall portion 24*a* of the first side-wall portion 23 and the second side-wall portion 24 from the base portion 21 are equal to each other. In this configuration, each of the two rib portions 22 may have the hole H8, which is an elongated hole, and the hole H9, which is a circular hole. Alternatively, a configuration is also possible in which one of the two rib portions 22 has the hole H8, which is an elongated hole, and the other rib portion 22 has the hole H9, which is a circular hole.

Figure 6:
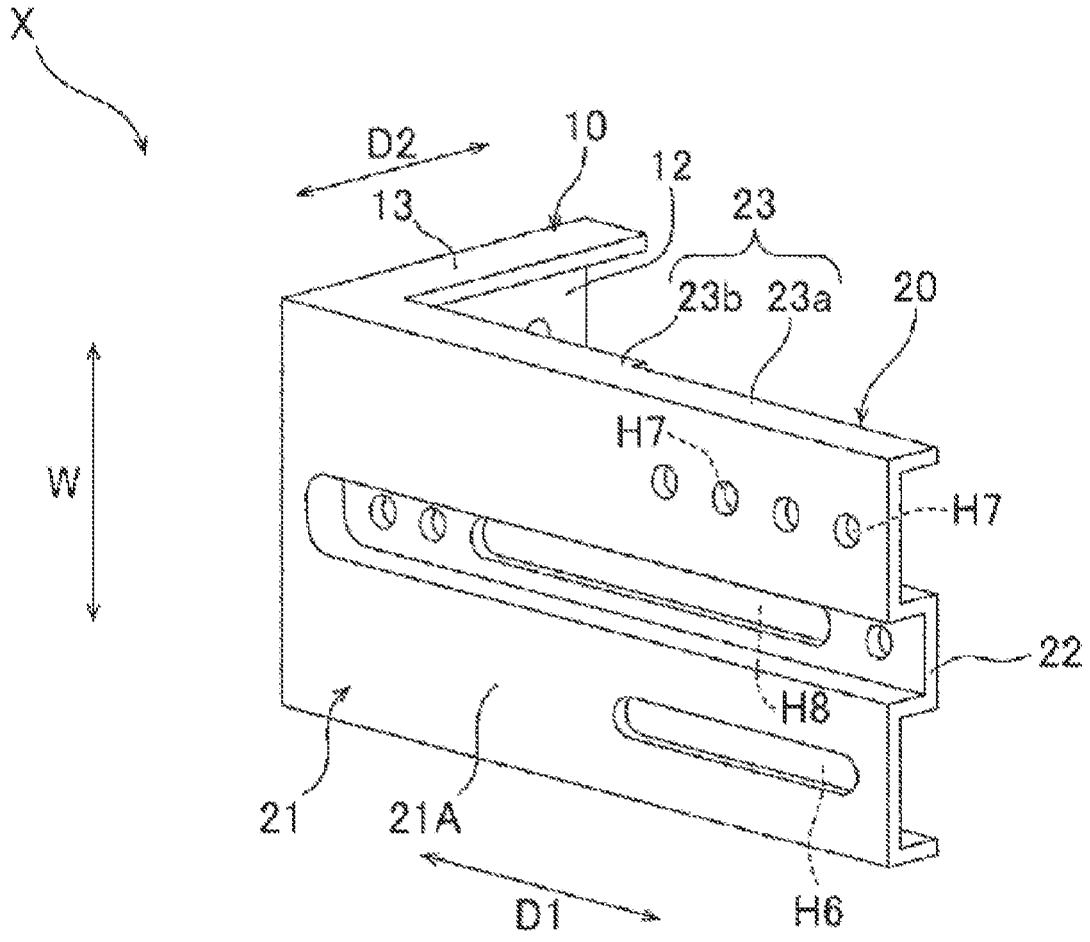
FIG. 6 is a perspective view illustrating yet another modification of the architectural bracket shown in FIG. 1.

As shown in FIG. 6, the bracket X may also include a rib portion 22 that extends over substantially the entire region of the second fixing portion 20 in the first direction D1. Such a configuration is preferable in terms of improving the strength of the second fixing portion 20 of the bracket X, that is, the strength of the bracket X.

Figure 7:
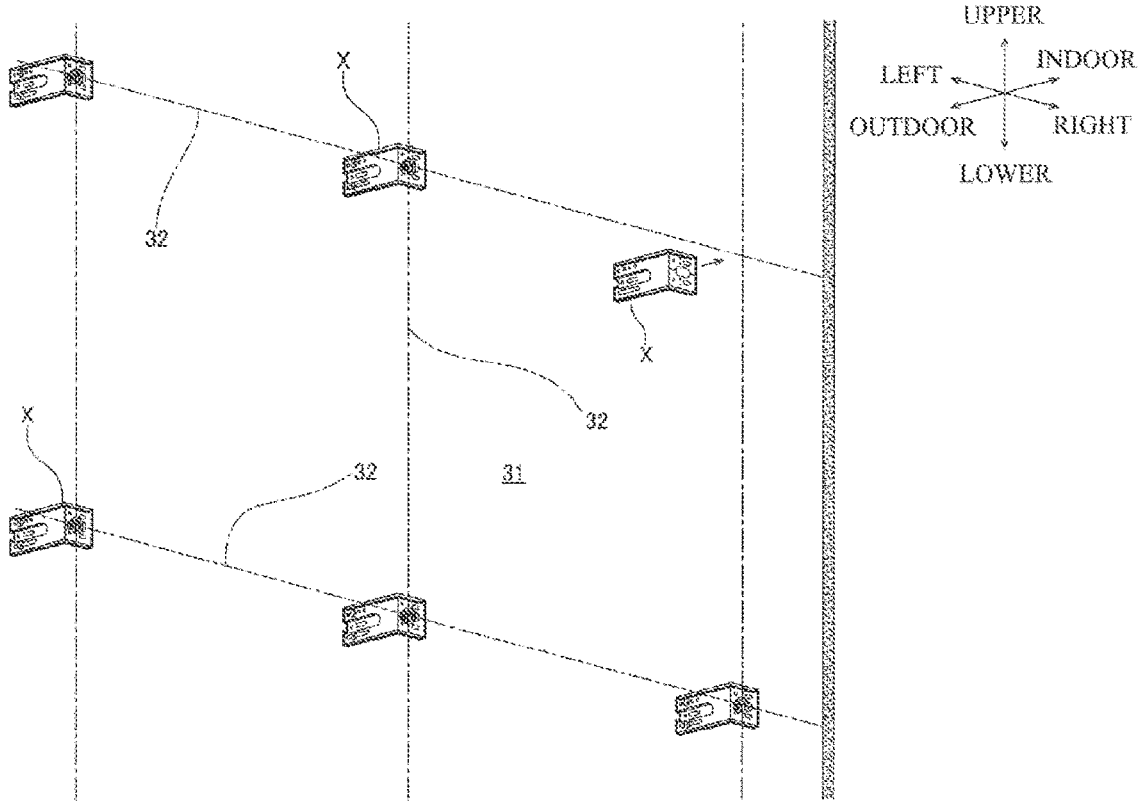
FIG. 7 illustrates an example of an aspect of securing brackets when constructing a wall structure.

The above-described brackets X are secured to a predetermined wall surface 31 of the skeleton structure in a predetermined arrangement when constructing a wall structure, as shown in, for example, FIG. 7 (FIG. 7 shows, as an example, a case where the skeleton structure is RC construction, and an anchor bolt is used as a fastening member of fastening the bracket X to the wall surface 31. The same applies to FIGS. 8 to 13). The wall surface 31 has black ink lines 32 in advance, and the intersections of the black ink lines 32 serve as a bracket securing position. Positioning of the brackets X on the wall surface 31 can be performed using the black ink lines 32, and the above-described reference lines L of the first fixing portion 10. That is to say, by arranging the brackets X so that the corresponding reference lines L overlap with the black ink lines 32 when viewed from an operator who faces the wall surface 31, the brackets X can be positioned.

Figure 8:
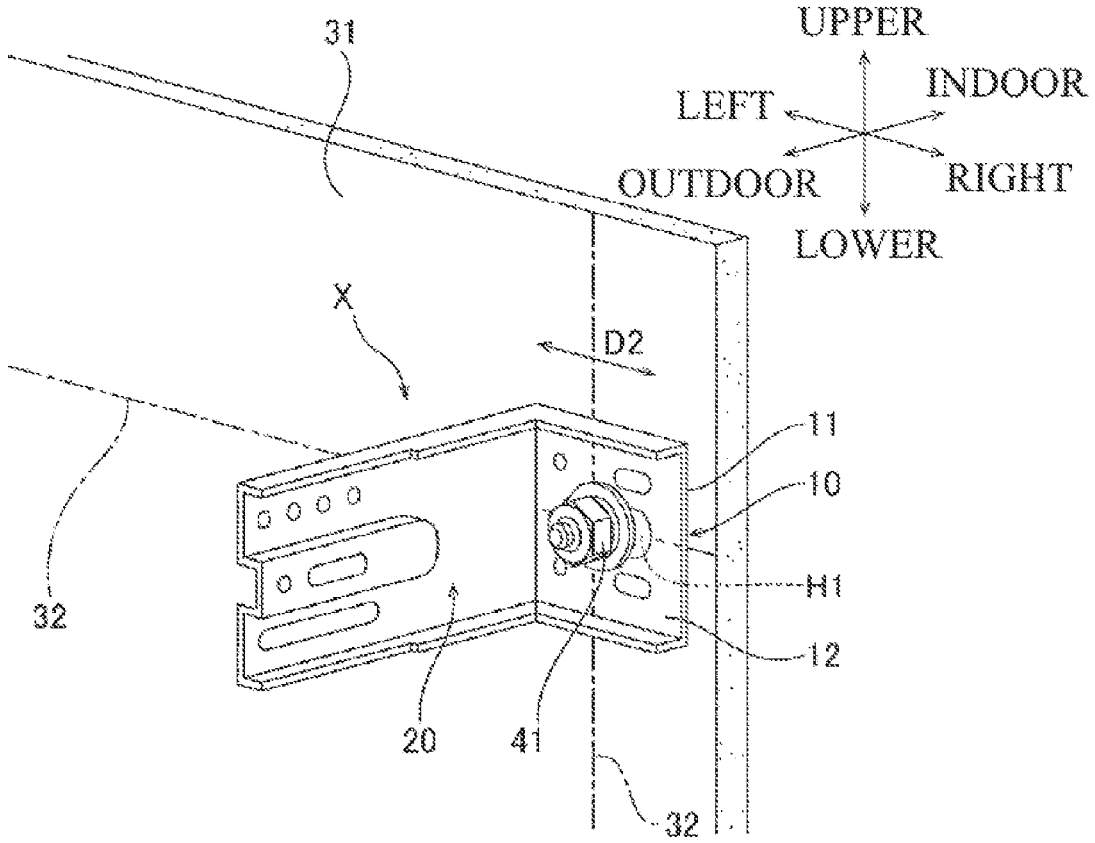
FIG. 8 illustrates an exemplified process of a supporting member mounting operation using a bracket when constructing a wall structure.
Figure 9:
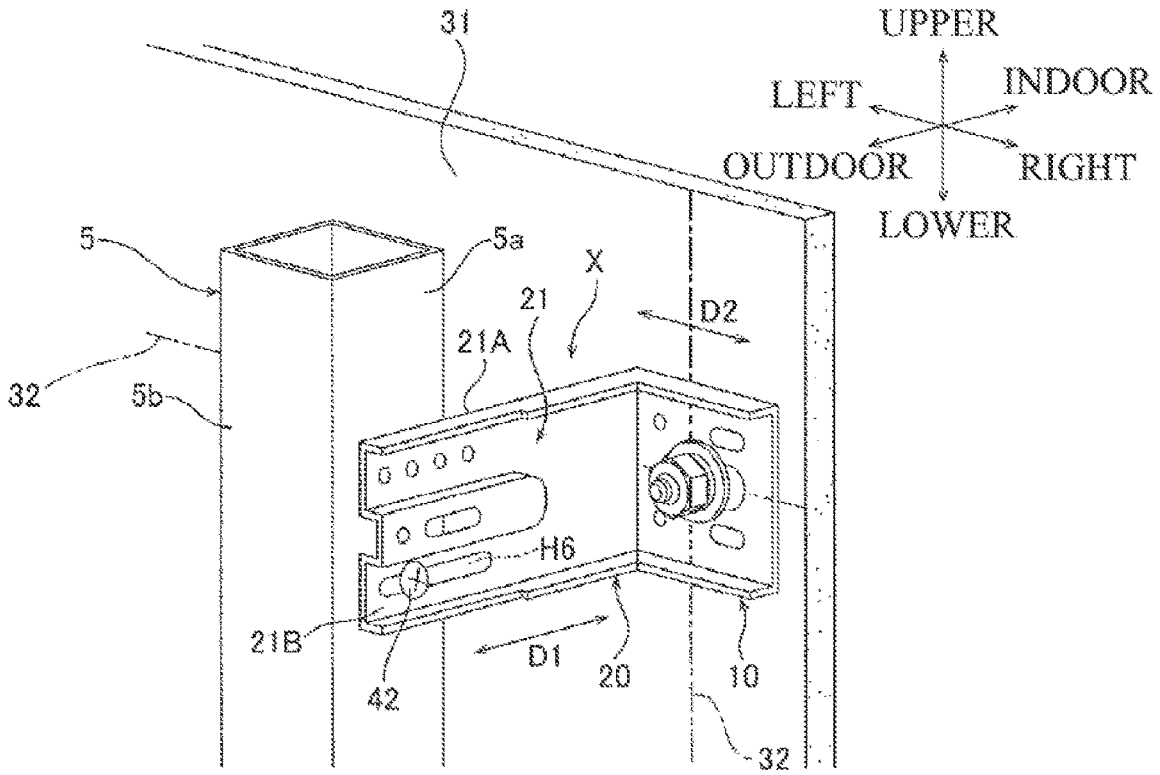
FIG. 9 illustrates a process that follows the process shown in FIG. 8.
Figure 10:
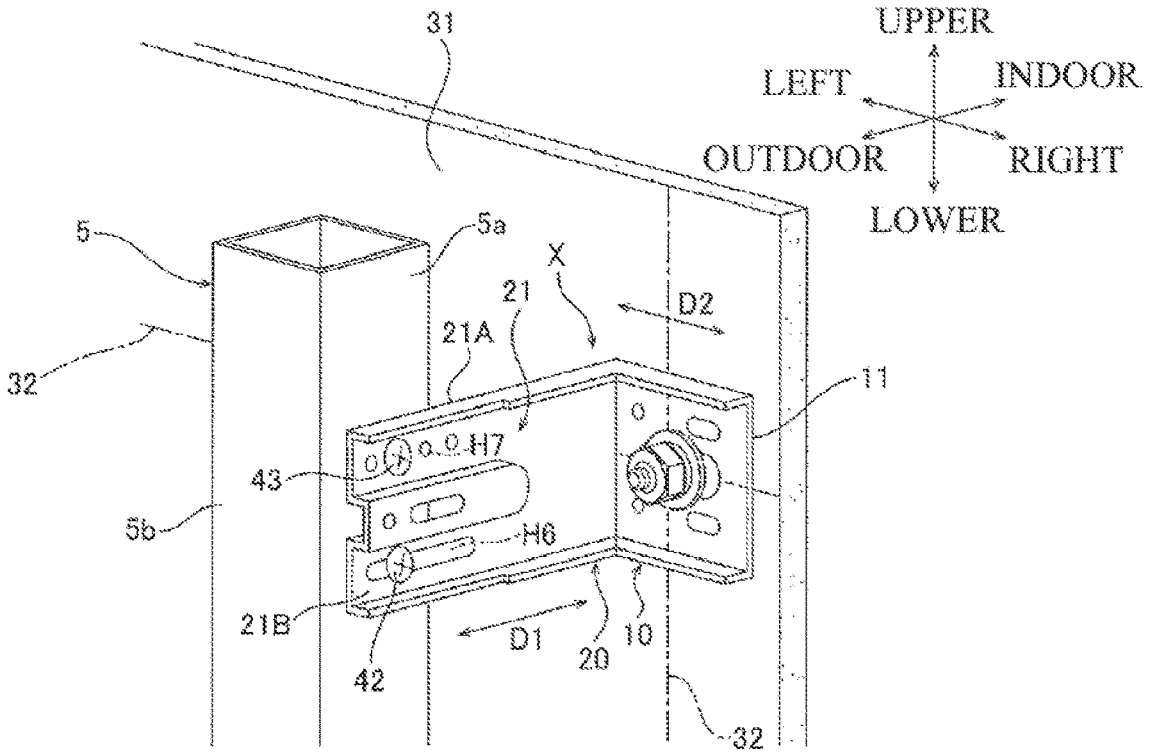
FIG. 10 illustrates a process that follows the process shown in FIG. 9.

FIGS. 8 to 10 illustrate an example of a supporting member mounting operation using the brackets X when constructing a wall structure. First, as shown in FIG. 8, the bracket X is fixed to the wall surface 31 of a skeleton structure by a fastening member 41 (first fastening member). Specifically, the surface 11 of the first fixing portion 10 of the bracket X is brought into contact with the wall surface 31 so that the bracket X is positioned, and then the bracket X, that is, the first fixing portion 10 thereof is fastened and fixed to the wall surface 31 by the fastening member 41. The fastening member 41 is, for example, an anchor bolt, and is passed through the hole H1 in the first fixing portion 10 from the surface 12 side (opposite to the surface 11) and reaches the wall surface 31 (a member other than an anchor bolt may be used as the fastening member 41). In this example of the mounting operation, the bracket X is fixed to the wall surface 31 in an orientation (first orientation) such that the second direction D2 thereof matches the horizontal direction, and the first fixing portion 10 extends along the wall surface 31 from an end of the second fixing portion 20 to the right side (right side when viewed by the operator who faces the wall surface 31).

When the bracket X is fixed to the wall surface 31 by the fastening member 41, there may be a case where the bracket X is shifted, for example, in the horizontal direction during an operation of fastening the bracket X to the wall surface 31 using the fastening member 41 in a state in which the reference lines L of the bracket X are aligned with the black ink lines 32 drawn on the wall surface 31. Even in such a case, since the hole H1 through which the fastening member 41 is inserted is an elongated hole, it is thus possible to perform fine adjustment of adjusting and aligning again the reference lines L with the black ink lines 32, and then fix the bracket X to the wall surface 31. The fine adjustment of adjusting and aligning again the reference lines L with the black ink lines 32 can also be performed when the hole H2 or the hole H3, which is an elongated hole, is used, instead of the hole H1 to fix the bracket X to the wall surface 31 using the fastening member 41.

Then, as shown in FIG. 9, a supporting member 5 is temporarily joined to the second fixing portion 20 of the bracket X by a fastening member 42 (second fastening member). The fastening member 42 is a drill screw. The supporting member 5 is, for example, a furring strip to which a plate material for constituting a wall surface is to be directly or indirectly secured when constructing a wall structure. As the supporting member 5, a hollow square material is shown as an example (the same applies to FIGS. 8 to 13). This supporting member 5 is arranged on the surface 21A side of the second fixing portion 20 of the bracket X in a position of extending in the vertical direction. Also, the supporting member 5 includes a first joining portion 5*a* that is fixed to the bracket X, and a second joining portion 5*b* that is connected to the side of the first joining portion 5*a* opposite to the wall surface 31.

In the process shown in FIG. 9, specifically, the first joining portion 5*a* of the supporting member 5 is brought into contact with the surface 21A of the base portion 21 of the second fixing portion 20 of the bracket X, and in this state, the bracket X and the supporting member 5 are temporarily joined to each other by the fastening member 42 that is passed through the hole H6 of the base portion 21 from the surface 21B side (opposite to the surface 21A) and reaches the first joining portion 5*a* of the supporting member 5. In the temporary joining, the fastening member 42 is shallowly screwed into the supporting member 5.

The position of the supporting member 5 temporarily joined to the second fixing portion 20 of the bracket X can be adjusted with respect to the bracket X in the first direction D1. Therefore, it is possible to perform unevenness adjustment on the supporting member 5 with respect to the wall surface 31 via the bracket X, as needed.

Then, as shown in FIG. 10, the supporting member 5 is fixed to the second fixing portion 20 of the bracket X by the fastening member 42 and a fastening member 43 (second fastening member). The fastening member 43 is a drill screw. In this process, specifically, the bracket X and the supporting member 5 are fastened and fixed to each other by the fastening member 42 that is to be further screwed from the above-described temporary joined state (that is to say, the fastening member 42 that is passed through the hole H6 of the base portion 21 from the surface 21B side and reaches the first joining portion 5*a* of the supporting member 5), and the fastening member 43 that is passed through the hole H7 of the base portion 21 from the surface 21B side, reaches the first joining portion 5*a* of the supporting member 5, and is screwed.

When constructing a wall structure, the bracket X can be used in, for example, the above-described manner to mount a predetermined supporting member on a wall surface of a skeleton structure.

Figure 11:
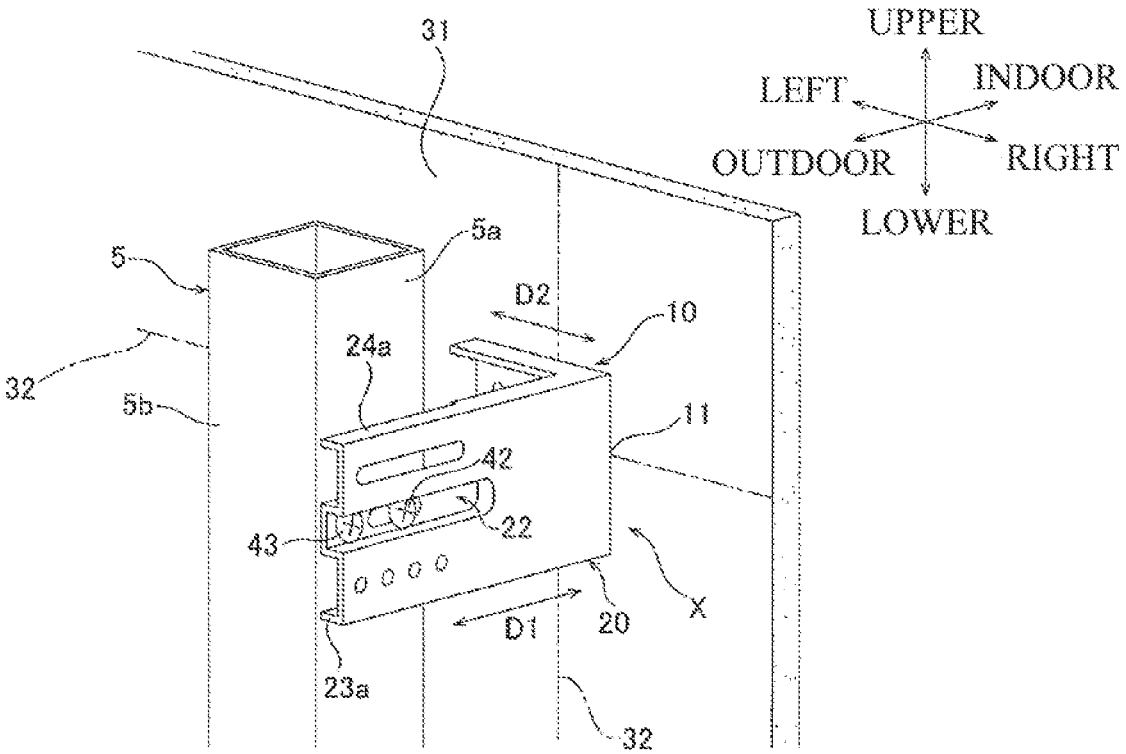
FIG. 11 illustrates another example 1 of the supporting member mounting aspect.
Figure 12:
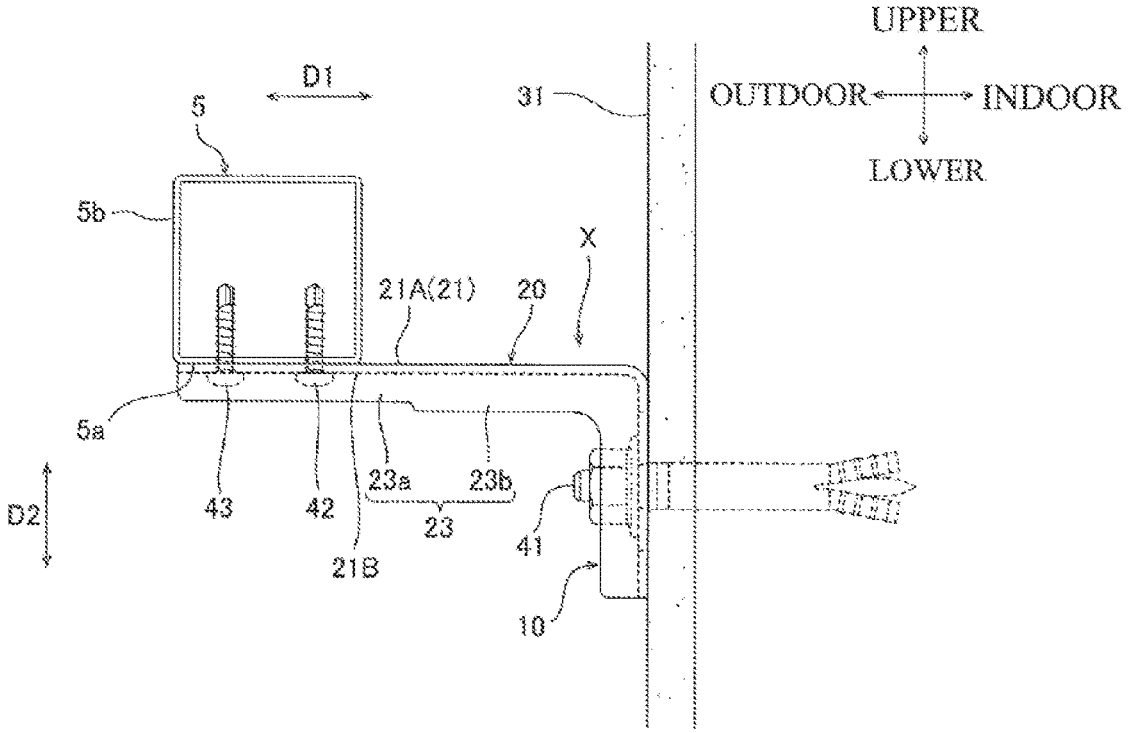
FIG. 12 illustrates yet another example 2 of the supporting member mounting aspect.
Figure 13:
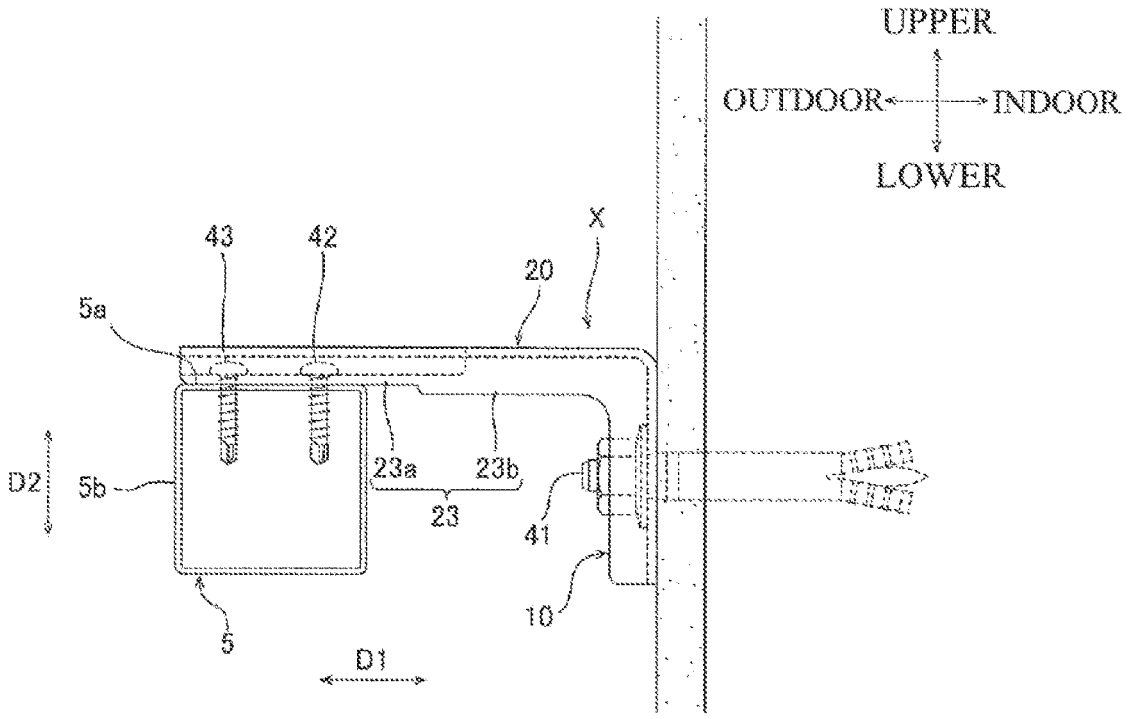
FIG. 13 illustrates yet another example 3 of the supporting member mounting aspect.

FIGS. 11 to 13 each illustrate another example of the supporting member mounting aspect.

In the example shown in FIG. 11, the bracket X is fixed to the wall surface 31 in an orientation (second orientation) such that the second direction D2 thereof matches the horizontal direction, and the first fixing portion 10 extends along the wall surface 31 from an end of the second fixing portion 20 to the left side (left side when viewed by an operator who faces the wall surface 31). Also, in the example shown in FIG. 11, the supporting member 5 is arranged on the surface 22A side (shown in FIG. 1, for example) of the second fixing portion 20 of the bracket X in a position of extending in the vertical direction. The supporting member 5 is fastened and fixed to the second fixing portion 20 of the bracket X by the fastening members 42 and 43 while being in contact with the surface 22A of the rib portion 22 of the second fixing portion 20. The fastening member 42 is passed through the hole H8 of the rib portion 22 from the side opposite to the surface 22A, and reaches the first joining portion 5*a* of the supporting member 5. The fastening member 43 is passed through the hole H9 of the rib portion 22 from the side opposite to the surface 22A, and reaches the first joining portion 5*a* of the supporting member 5.

The mounting aspect shown in FIG. 11 can be realized, for example, by performing a fixing operation using the fastening member 41 (fixing the first fixing portion 10 to the wall surface 31), a temporary joining operation using the fastening member 42 (temporary joining the supporting member 5 to the second fixing portion 20) and subsequent unevenness adjustment of the supporting member 5 that is performed as needed, and a fixing operation using the fastening members 42 and 43 (fixing the supporting member 5 to the second fixing portion 20). In the unevenness adjustment that is performed after the supporting member 5 has been temporarily joined, specifically, the position of the supporting member 5 temporarily joined to the second fixing portion 20 of the bracket X can be adjusted with respect to the bracket X in the first direction D1.

In the example shown in FIG. 12, the bracket X is fixed to the wall surface 31 in an orientation (third orientation) such that the second direction D2 thereof matches the vertical direction, and the first fixing portion 10 extends downward along the wall surface 31 from an end of the second fixing portion 20. Also, in the example shown in FIG. 12, the supporting member 5 is arranged on the surface 21A side of the second fixing portion 20 of the bracket X in a position of extending in the horizontal direction. The supporting member 5 is fastened and fixed to the second fixing portion 20 of the bracket X by the fastening members 42 and 43 while being in contact with the surface 21A of the base portion 21 of the second fixing portion 20. The fastening member 42 is passed through the hole H6 (shown in FIG. 1, for example) of the rib portion 21 from the surface 21B side (opposite to the surface 21A), and reaches the first joining portion 5*a* of the supporting member 5. The fastening member 43 is passed through the hole H7 (shown in FIG. 1, for example) of the rib portion 21 from the surface 21B side, and reaches the first joining portion 5*a* of the supporting member 5.

The mounting aspect shown in FIG. 12 can be realized, for example, by performing a fixing operation using the fastening member 41 (fixing the first fixing portion 10 to the wall surface 31), a temporary joining operation using the fastening member 42 (temporary joining the supporting member 5 to the second fixing portion 20) and subsequent unevenness adjustment of the supporting member 5 that is performed as needed, and a fixing operation using the fastening members 42 and 43 (fixing the supporting member 5 to the second fixing portion 20). In the unevenness adjustment that is performed after the supporting member 5 has been temporarily joined, specifically, the position of the supporting member 5 temporarily joined to the second fixing portion 20 of the bracket X can be adjusted with respect to the bracket X in the first direction D1.

In the example shown in FIG. 13, the bracket X is fixed to the wall surface 31 in an orientation (fourth orientation) such that the second direction D2 thereof matches the vertical direction, and the first fixing portion 10 extends downward along the wall surface 31 from an end of the second fixing portion 20. Also, in the example shown in FIG. 13, the supporting member 5 is arranged on the surface 22A side (shown in FIG. 1, for example) of the second fixing portion 20 of the bracket X in a position of extending in the horizontal direction. The supporting member 5 is fastened and fixed to the second fixing portion 20 of the bracket X by the fastening members 42 and 43 while being in contact with the surface 22A of the rib portion 22 of the second fixing portion 20. The fastening member 42 is passed through the hole H8 (shown in FIG. 1, for example) of the rib portion 22 from the side opposite to the surface 22A, and reaches the first joining portion 5*a* of the supporting member 5. The fastening member 43 is passed through the hole H9 (shown in FIG. 1, for example) of the rib portion 22 from the side opposite to the surface 22A, and reaches the first joining portion 5*a* of the supporting member 5.

The mounting aspect shown in FIG. 13 can be realized, for example, by performing a fixing operation using the fastening member 41 (fixing the first fixing portion 10 to the wall surface 31), a temporary joining operation using the fastening member 42 (temporary joining the supporting member 5 to the second fixing portion 20) and subsequent unevenness adjustment of the supporting member 5 that is performed as needed, and a fixing operation using the fastening members 42 and 43 (fixing the supporting member 5 to the second fixing portion 20). In the unevenness adjustment that is performed after the supporting member 5 has been temporarily joined, specifically, the position of the supporting member 5 temporarily joined to the second fixing portion 20 of the bracket X can be adjusted with respect to the bracket X in the first direction D1.

For example, in the bracket X used in the above-described manner, the second fixing portion 20 to be fastened to a fixation object (the supporting member 5 in the above-described examples) includes the rib portion 22 in the base portion 21, as well as the first side-wall portion 23 and the second side-wall portion 24 that protrude from the base portion 21 to the same side as the side to which the rib portion 22 protrudes. Such a configuration is suitable for improving the strength of the architectural bracket X in terms of being able to endure wall structure construction operations including so-called unevenness adjustment and so on, and the strength to continuously hold the constructed wall structure.

Also, as described above, the second fixing portion 20 of the bracket X to be fastened to a fixation object includes, as surfaces for coming into contact with a member, the surface 21A and the surface 22A opposite to this. Such a configuration is suitable for realizing a high degree of freedom in terms of the arrangement relationship between the bracket X and a fixation object when constructing a wall structure, as described above. That is to say, the bracket X can be used in various orientations and mounting aspects.

As described above, the bracket X is suitable for improving its strength and realizing a high degree of freedom in terms of the arrangement relationship with a fixation object in construction. The improvement in the strength of the bracket X is suitable for preventing the bracket X from deforming in the building wall structure in which the bracket X is used, and thus is suitable for stably supporting the fixation object fixed by the bracket X and another member, such as a plank member for constituting a wall portion, that is fixed to this fixation object.

Also, in the bracket X, the above-described configuration in which the first wall portion 23*a* of the first side-wall portion 23, the second wall portion 24*a* of the second side-wall portion 24, and the rib portion 22 interposed therebetween protrude to the same side from the base portion 21, and are arranged in parallel to each other makes the second fixing portion 20 likely to come into contact with a fixation object at three positions when the fixation object is arranged on the surface 22A side of the second fixing portion 20 and is fastened with the second fixing portion 20. The configuration in which the second fixing portion 20 comes into contact with a fixation object at three positions is suitable for the second fixing portion 20 or the bracket X to stably support a fixation object or another member, such as a plank member for constituting a wall surface, that is fixed to this fixation object.

As described above, in the bracket X, the protrusion heights of the surface 22A, the first wall portion 23*a*, and the second wall portion 24*a* from the base portion 21 are equal to each other. Such a configuration is suitable for the second fixing portion 20 to come into contact with a fixation object at three positions when the fixation object is arranged on the surface 22A side of the second fixing portion 20 and is fastened to the second fixing portion 20, and is thus suitable for the second fixing portion 20, that is, the bracket X to stably support a fixation object or another member, such as a plank member for constituting a wall surface, that is fixed to the fixation object.

As described above, in the bracket X, the first fixing portion 10 includes the third side-wall portion 13 that protrudes from an end of the first fixing portion 10 in the width direction W to the same side as the side to which the second fixing portion 20 protrudes, and the fourth side-wall portion 14 that protrudes from the other end of the first fixing portion 10 in the width direction W to the same side as the side to which the second fixing portion 20 protrudes. The first side-wall portion 23 of the second fixing portion 20 and the third side-wall portion 13 of the first fixing portion 10 are connected to each other, and the second side-wall portion 24 of the second fixing portion 20 and the fourth side-wall portion 14 of the first fixing portion 10 are connected to each other. Such a configuration is preferable in terms of improving the strength of the bracket X.

As described above, in the bracket X, the first side-wall portion 23 includes, on the first fixing portion 10 side relative to the first wall portion 23*a*, a first high wall portion 23*b* that is higher than the first wall portion 23*a*, and the second side-wall portion 24 includes, on the first fixing portion 10 side relative to the second wall portion 24*a*, a second high wall portion 24*b* that is higher than the second wall portion 24*a*. Such a configuration is preferable in terms of improving the strength of the bracket X.

As described above, the bracket X has in advance the holes such as the holes H1 to H9. Such a configuration is suitable for eliminating or avoiding an operation of forming, in the bracket X, a hole through which a fastening member is to be passed when constructing a wall structure using the bracket X, thereby simplifying the construction operation. In addition, the holes H6 and H8, which are elongated holes formed in the second fixing portion 20 and extending in the first direction D1, can be used in the above-described unevenness adjustment.

As described above, in the bracket X, the surface 12 of the first fixing portion 10 is provided with the reference lines L for use in positioning. Such a configuration is useful in positioning the bracket X when constructing a wall structure using the bracket X.

Figure 14:
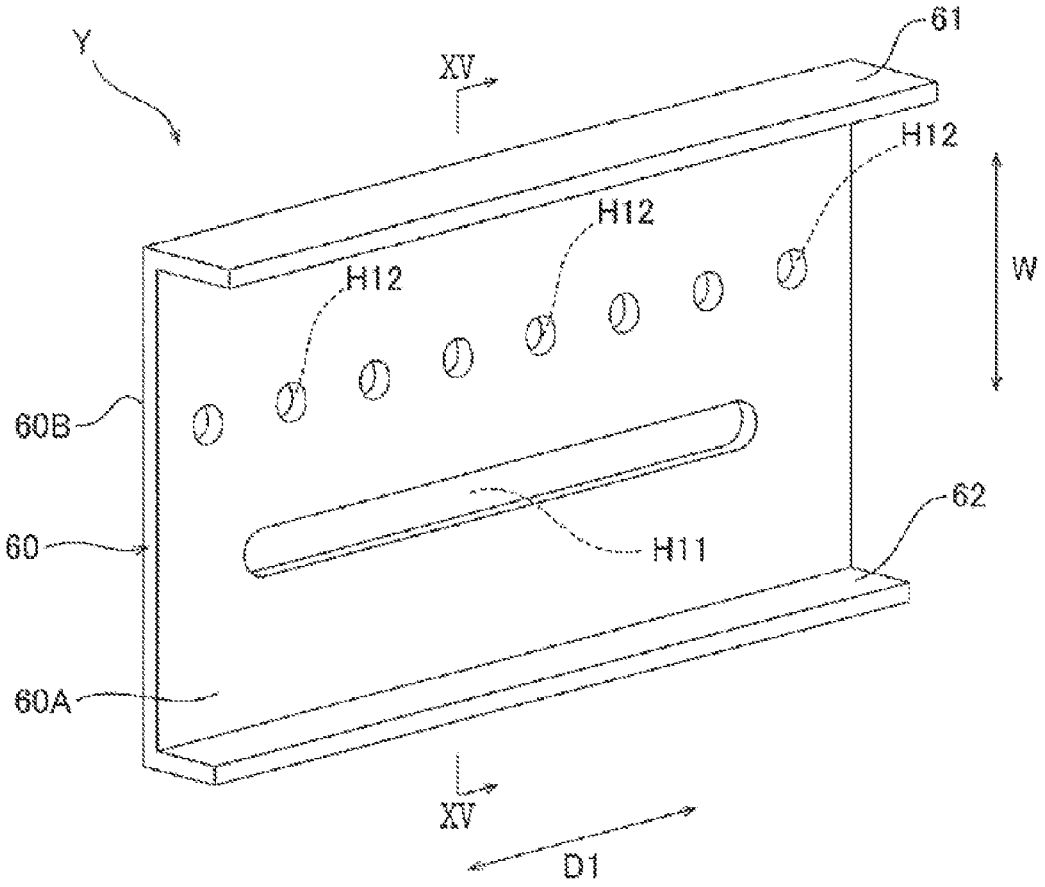
FIG. 14 is a perspective view illustrating an extension member.
Figure 15:
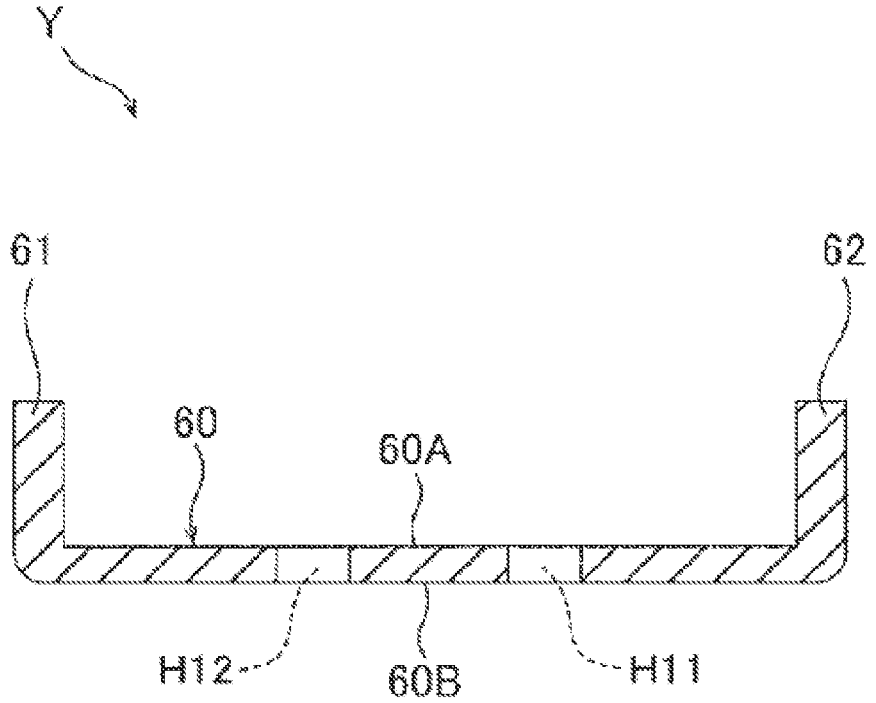
FIG. 15 is a cross-sectional view taken along XV-XV of the extension member shown in FIG. 14.

As shown in, for example, FIGS. 16 to 19, an extension member Y together with the bracket X can be used in mounting a supporting member using the bracket X when constructing a wall structure. FIG. 14 is a perspective view illustrating the extension member Y FIG. 15 is a cross-sectional view taken along XV-XV of the extension member Y shown in FIG. 14.

The extension member Y includes an extension base portion 60, a first extension side-wall portion 61, and a second extension side-wall portion 62. The extension base portion 60 has a shape extending in one direction (the first direction D1 in the mounting state shown in FIGS. 16 to 19), and has a width in a direction (the width direction W) orthogonal to the one direction.

The extension base portion 60 includes a surface 60A (fourth surface) for coming into contact with the surface 21A or the surface 22A of the base portion 21 of the bracket X, and a surface 60B (fifth surface) for coming into contact with a member located opposite to the surface 60A. The dimension of the extension base portion 60 in the first direction D1 is, for example, 70 to 150 mm. The width of the extension base portion 60 (dimension in the width direction W) is, for example, 31 to 85 mm.

The first extension side-wall portion 61 protrudes from an end of the extension base portion 60 in the width direction W to the surface 60A side in a thickness direction of the extension base portion 60. The second extension side-wall portion 62 protrudes from the other end of the extension base portion 60 in the width direction W to the surface 60A side in the thickness direction of the extension base portion 60. The protrusion heights of the first extension side-wall portion 61 and the second extension side-wall portion 62 from the surface 60A are both between 5 and 15 mm, for example.

In the present embodiment, the extension base portion 60 has a hole H11 through which a fastening member is to be passed, and eight holes H12 through which a fastening member is to be passed, the eight holes H12 being lined up in the first direction D1. The hole H11 is an elongated hole extending in the first direction D1. The dimension of the hole H11 in the first direction D1 is, for example, 50 to 120 mm, and the dimension of the hole H11 in the width direction W is, for example, 3 to 7 mm. The holes H12 are circular holes, and are spaced apart from the hole H11 in the width direction W. The diameter of the holes H12 is, for example, 3 to 7 mm.

The extension member Y having the above-described configuration can be manufactured by performing punching and bending on a metal plate such as a steel plate, for example. The thickness of a metal plate that is used to manufacture the extension base portion 60 is, for example, 1 to 5 mm.

In an example shown in FIG. 16, the bracket X is fixed to the wall surface 31 in a first orientation similar to the orientation described with reference to FIG. 8. The extension member Y is mounted to this bracket X in a first aspect below.

In the first aspect, the second fixing portion 20 of the bracket X is interposed between the first extension side-wall portion 61 and the second extension side-wall portion 62 of the extension member Y, while the surface 60A of the extension member Y is in contact with the surface 21A (shown in FIG. 2, for example) of the second fixing portion 20 of the bracket X. The extension member Y is elongated while extending, in the first direction D1, from the second fixing portion 20 of the bracket X to the side opposite to the first fixing portion 10. Also, the extension member Y is fastened and fixed to the second fixing portion 20 of the bracket X by fastening members 44 and 45 (third fastening members) while being in contact with the surface 21A of the second fixing portion 20 of the bracket X. The fastening member 44 is passed through the hole H6 of the base portion 21 from the surface 21B side, and reaches the extension member Y. The fastening member 45 is passed through the hole H7 of the base portion 21 from the surface 21B side, and reaches the extension member Y. The fastening members 44 and 45 are drill screws.

Figure 16:
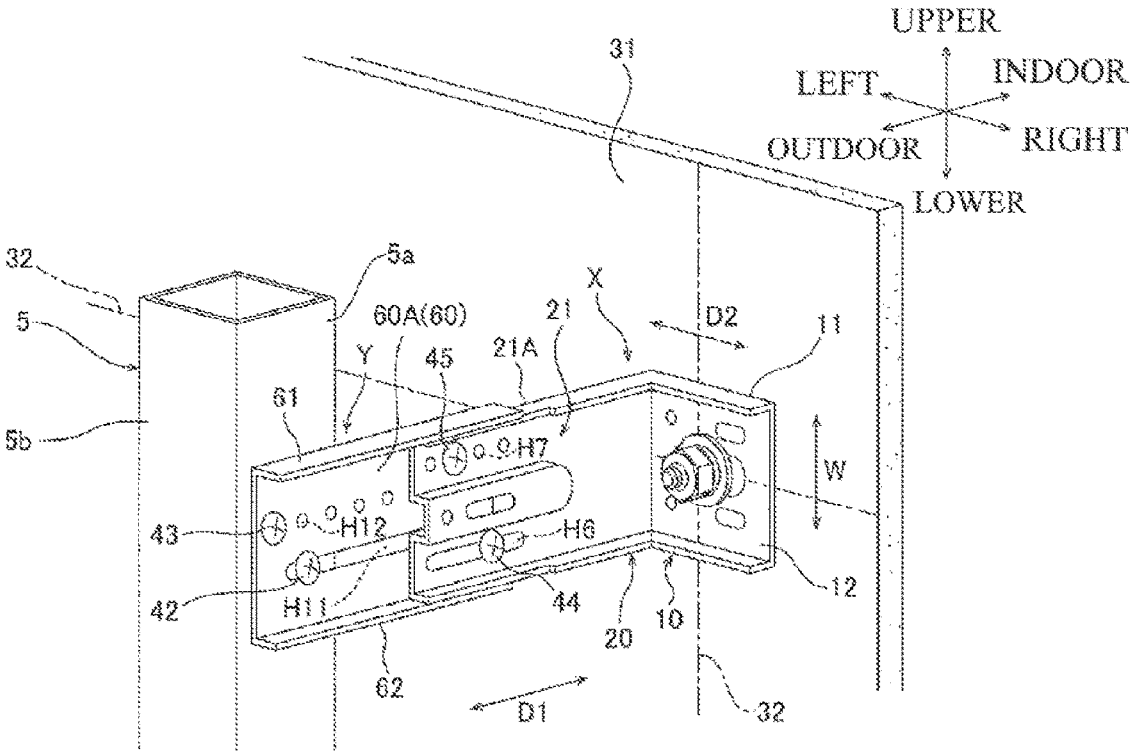
FIG. 16 illustrates an example of the supporting member mounting aspect using the architectural bracket and the extension member.

Also, in the example shown in FIG. 16, the supporting member 5 is arranged on the surface 60B side (opposite to the surface 60A) of the extension base portion 60 of the extension member Y in a position of extending in the vertical direction. The supporting member 5 is fastened and fixed to the extension member Y by the fastening members 42 and 43 while being in contact with the surface 60B. The fastening member 42 is passed through the hole H11 of the extension base portion 60 of the extension member Y from the surface 60A side, and reaches the first joining portion 5*a* of the supporting member 5. The fastening member 43 is passed through the hole H12 of the extension base portion 60 from the surface 60A side, and reaches the first joining portion 5*a* of the supporting member 5.

The mounting aspect shown in FIG. 16 can be realized, for example, by performing a first fixing operation using the fastening member 41, a first temporary joining operation using the fastening member 44 and subsequent first unevenness adjustment of the extension member Y that is performed as needed, a second fixing operation using the fastening members 44 and 45, a second temporary joining operation using the fastening member 42 and subsequent second unevenness adjustment of the supporting member 5 that is performed as needed, and a third fixing operation using the fastening member 42 and 43.

In the first fixing operation for the mounting aspect shown in FIG. 16, the first fixing portion 10 is fixed to the wall surface 31. In the first temporary joining operation, the extension member Y is temporarily joined to the bracket X by the fastening member 44 that is passed through the hole H6 of the bracket X and is shallowly screwed into the extension member Y. In the second fixing operation, the extension member Y is fixed to the bracket X. In the second temporary joining operation, the supporting member 5 is temporarily joined to the extension member Y by the fastening member 42 that is passed through the hole H11 of the extension member Y and is shallowly screwed into the supporting member 5. In the third fixing operation, the supporting member 5 is fixed to the extension member Y.

Also, in the first unevenness adjustment after the first temporary joining of joining the extension member Y to the bracket X, specifically, the position of the extension member Y temporarily joined to the second fixing portion 20 of the bracket X can be adjusted with respect to the bracket X in the first direction D1. In the second unevenness adjustment after the second temporary joining of joining the supporting member 5 to the extension member Y, specifically the position of the supporting member 5 temporarily joined to the extension member Y can be adjusted with respect to the extension member Y and the bracket X in the first direction D1. Therefore, by adjusting these fixation positions, it is possible to perform unevenness adjustment on the supporting member 5 with respect to the wall surface 31, as needed.

In an example shown in FIG. 17, the bracket X is fixed to the wall surface 31 in a second orientation similar to the orientation described with reference to FIG. 11. The extension member Y is mounted to this bracket X in a second aspect below.

In the second aspect, the second fixing portion 20 of the bracket X is interposed between the first extension side-wall portion 61 and the second extension side-wall portion 62 of the extension member Y, while the surface 60A of the extension member Y is in contact with the surface 22A (shown in FIG. 1, for example), the first wall portion 23*a*, and the second wall portion 24*a* of the second fixing portion 20 of the bracket X. The extension member Y is elongated while extending, in the first direction D1, from the second fixing portion 20 of the bracket X to the side opposite to the first fixing portion 10. Also, the extension member Y is fastened and fixed to the second fixing portion 20 of the bracket X by the fastening members 44 and 45 while being in contact with the surface 22A of the second fixing portion 20 of the bracket X. The fastening member 44 is passed through the hole H8 of the rib portion 22 from the side opposite to the surface 22A, and reaches the extension member Y. The fastening member 45 is passed through the hole H9 (shown in FIG. 1, for example) of the rib portion 22 from the side opposite to the surface 22A, and reaches the extension member Y.

Figure 17:
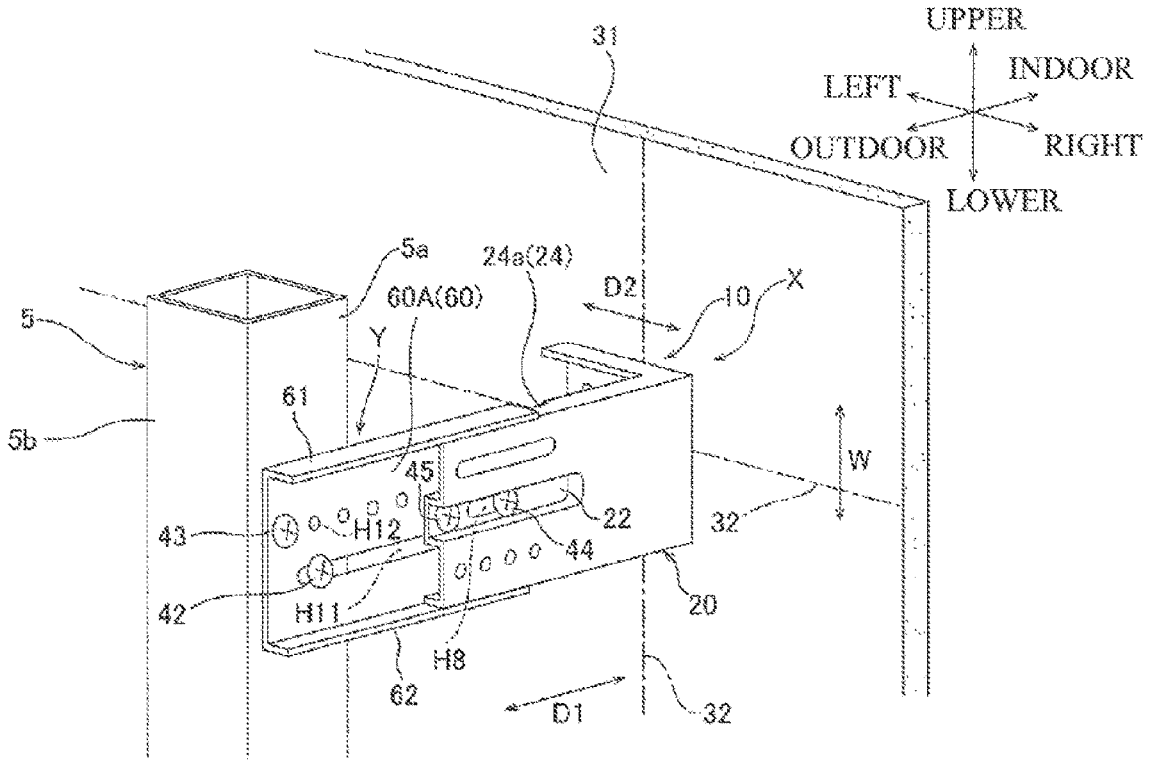
FIG. 17 illustrates another example 1 of the supporting member mounting aspect using the architectural bracket and the extension member.

Also, in the example shown in FIG. 17, the supporting member 5 is arranged on the surface 60B side (opposite to the surface 60A) of the extension base portion 60 of the extension base portion Y in a position of extending in the vertical direction. The supporting member 5 is fastened and fixed to the extension member Y by the fastening members 42 and 43 while being in contact with the surface 60B. The fastening member 42 is passed through the hole H11 of the extension base portion 60 of the extension member Y from the surface 60A side, and reaches the first joining portion 5*a* of the supporting member 5. The fastening member 43 is passed through the hole H12 of the extension base portion 60 from the surface 60A side, and reaches the first joining portion 5*a* of the supporting member 5.

The mounting aspect shown in FIG. 17 can be realized, for example, by performing a first fixing operation using the fastening member 41 (fixing the first fixing portion 10 to the wall surface 31), a temporary joining operation using the fastening member 44 and subsequent first unevenness adjustment of the extension member Y that is performed as needed, a second fixing operation using the fastening members 44 and 45, a second temporary joining operation using the fastening member 42 and subsequent second unevenness adjustment of the supporting member 5 that is performed as needed, and a third fixing operation using the fastening member 42 and 43.

In the first fixing operation for the mounting aspect shown in FIG. 17, the first fixing portion 10 is fixed to the wall surface 31. In the first temporary joining operation, the extension member Y is temporarily joined to the bracket X by the fastening member 44 that is passed through the hole H8 of the bracket X and is shallowly screwed into the extension member Y. In the second fixing operation, the extension member Y is fixed to the bracket X. In the second temporary joining operation, the supporting member 5 is temporarily joined to the extension member Y by the fastening member 42 that is passed through the hole H11 of the extension member Y and is shallowly screwed into the supporting member 5. In the third fixing operation, the supporting member 5 is fixed to the extension member Y.

Also, in the first unevenness adjustment after the temporary joining of joining the extension member Y to the bracket X, specifically, the position of the extension member Y temporarily joined to the second fixing portion 20 of the bracket X can be adjusted with respect to the bracket X in the first direction D1. In the second unevenness adjustment after the temporary joining of joining the supporting member 5 to the extension member Y, specifically, the position of the supporting member 5 temporarily joined to the extension member Y can be adjusted with respect to the extension member Y and the bracket X in the first direction D1. Therefore, by adjusting these fixation positions, it is possible to perform unevenness adjustment on the supporting member 5 with respect to the wall surface 31, as needed.

In an example shown in FIG. 18, the bracket X is fixed to the wall surface 31 in a third orientation similar to the orientation described with reference to FIG. 12. The extension member Y is mounted to this bracket X in a third aspect below.

In the third aspect, the second fixing portion 20 of the bracket X is interposed between the first extension side-wall portion 61 and the second extension side-wall portion 62 of the extension member Y, while the surface 60A of the extension member Y is in contact with the surface 21A (shown in FIG. 2, for example) of the second fixing portion 20 of the bracket X. The extension member Y is elongated while extending, in the first direction D1, from the second fixing portion 20 of the bracket X to the side opposite to the first fixing portion 10. Also, the extension member Y is fastened and fixed to the second fixing portion 20 of the bracket X by the fastening members 44 and 45 while being in contact with the surface 21A of the second fixing portion 20 of the bracket X. The fastening member 44 is passed through the hole H6 (shown in FIG. 1, for example) of the base portion 21 from the surface 21B side, and reaches the extension member Y. The fastening member 45 is passed through the hole H7 (shown in FIG. 1, for example) of the base portion 21 from the surface 21B side, and reaches the extension member Y.

Figure 18:
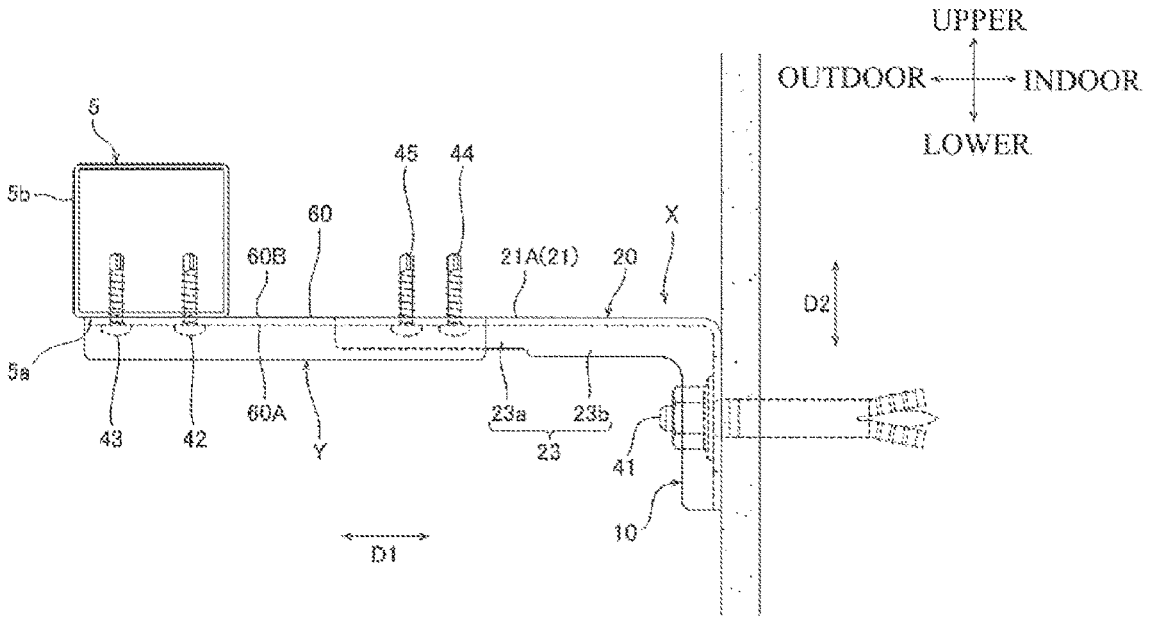
FIG. 18 illustrates yet another example 2 of the supporting member mounting aspect using the architectural bracket and the extension member.

Also, in the example shown in FIG. 18, the supporting member 5 is arranged on the surface 60B side (opposite to the surface 60A) of the extension base portion 60 of the extension base portion Y in a position of extending in the horizontal direction. The supporting member 5 is fastened and fixed to the extension member Y by the fastening members 42 and 43 while being in contact with the surface 60B. The fastening member 42 is passed through the hole H11 of the extension base portion 60 of the extension member Y from the surface 60A side, and reaches the first joining portion 5*a* of the supporting member 5. The fastening member 43 is passed through the hole H12 of the extension base portion 60 from the surface 60A side, and reaches the first joining portion 5*a* of the supporting member 5.

The mounting aspect shown in FIG. 18 can be realized, for example, by performing a first fixing operation using the fastening member 41, a temporary joining operation using the fastening member 44 and subsequent first unevenness adjustment of the extension member Y that is performed as needed, a second fixing operation using the fastening members 44 and 45, a second temporary joining operation using the fastening member 42 and subsequent second unevenness adjustment of the supporting member 5 that is performed as needed, and a third fixing operation using the fastening member 42 and 43.

In the first fixing operation for the mounting aspect shown in FIG. 18, the first fixing portion 10 is fixed to the wall surface 31. In the first temporary joining operation, the extension member Y is temporarily joined to the bracket X by the fastening member 44 that is passed through the hole H6 of the bracket X and is shallowly screwed into the extension member Y. In the second fixing operation, the extension member Y is fixed to the bracket X. In the second temporary joining operation, the supporting member 5 is temporarily joined to the extension member Y by the fastening member 42 that is passed through the hole H7 of the extension member Y and is shallowly screwed into the supporting member 5. In the third fixing operation, the supporting member 5 is fixed to the extension member Y.

Also, in the first unevenness adjustment after the temporary joining of joining the extension member Y to the bracket X, specifically, the position of the extension member Y temporarily joined to the second fixing portion 20 of the bracket X can be adjusted with respect to the bracket X in the first direction D1. In the second unevenness adjustment after the temporary joining of joining the supporting member 5 to the extension member Y, specifically, the position of the supporting member 5 temporarily joined to the extension member Y can be adjusted with respect to the extension member Y and the bracket X in the first direction D1. Therefore, by adjusting these fixation positions, it is possible to perform unevenness adjustment on the supporting member 5 with respect to the wall surface 31, as needed.

In an example shown in FIG. 19, the bracket X is fixed to the wall surface 31 in a fourth orientation similar to the orientation described with reference to FIG. 13. The extension member Y is mounted to this bracket X in a fourth aspect below.

In the fourth aspect, the second fixing portion 20 of the bracket X is interposed between the first extension side-wall portion 61 and the second extension side-wall portion 62 of the extension member Y, while the surface 60A of the extension member Y is in contact with the surface 22A (shown in FIG. 1, for example), the first wall portion 23*a*, and the second wall portion 24*a* of the second fixing portion 20 of the bracket X. The extension member Y is elongated while extending, in the first direction D1, from the second fixing portion 20 of the bracket X to the side opposite to the first fixing portion 10. Also, the extension member Y is fastened and fixed to the second fixing portion 20 of the bracket X by the fastening members 44 and 45 while being in contact with the surface 22A of the second fixing portion 20 of the bracket X. The fastening member 44 is passed through the hole H8 (shown in FIG. 1, for example) of the rib portion 22 from the side opposite to the surface 22A, and reaches the extension member Y. The fastening member 45 is passed through the hole H9 (shown in FIG. 1, for example) of the rib portion 22 from the side opposite to the surface 22A, and reaches the extension member Y.

Figure 19:
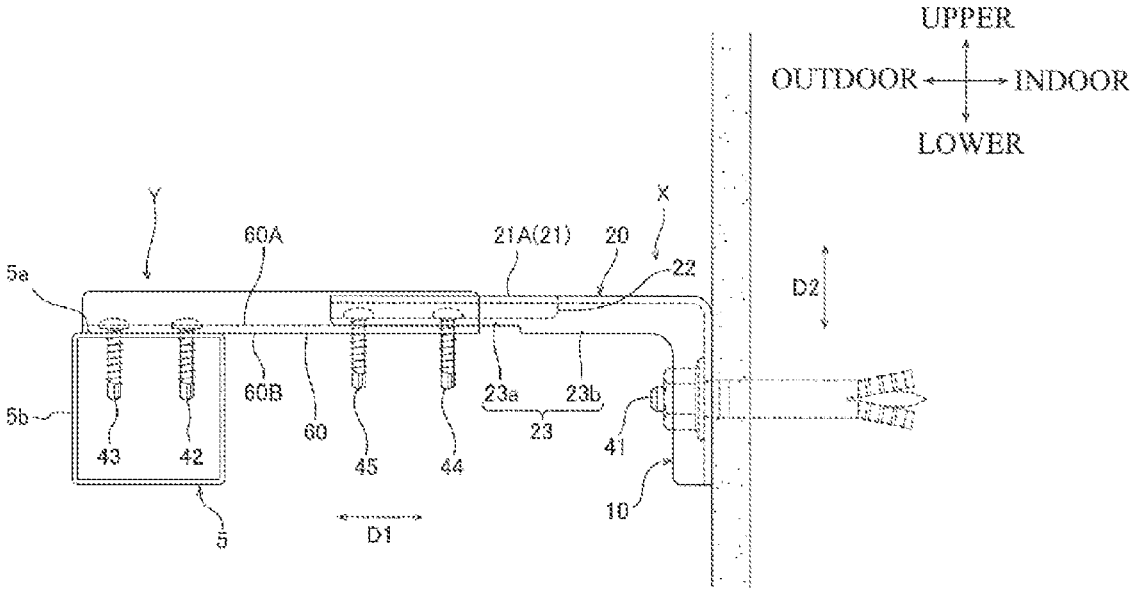
FIG. 19 illustrates yet another example 3 of the supporting member mounting aspect using the architectural bracket and the extension member.

Also, in the example shown in FIG. 19, the supporting member 5 is arranged on the surface 60B side (opposite to the surface 60A) of the extension base portion 60 of the extension base portion Y in a position of extending in the horizontal direction. The supporting member 5 is fastened and fixed to the extension member Y by the fastening members 42 and 43 while being in contact with the surface 60B. The fastening member 42 is passed through the hole H11 of the extension base portion 60 of the extension member Y from the surface 60A side, and reaches the first joining portion 5*a* of the supporting member 5. The fastening member 43 is passed through the hole H12 of the extension base portion 60 from the surface 60A side, and reaches the first joining portion 5*a* of the supporting member 5.

The mounting aspect shown in FIG. 19 can be realized, for example, by performing a first fixing operation using the fastening member 41, a temporary joining operation using the fastening member 44 and subsequent first unevenness adjustment of the extension member Y that is performed as needed, a second fixing operation using the fastening members 44 and 45, a second temporary joining operation using the fastening member 42 and subsequent second unevenness adjustment of the supporting member 5 that is performed as needed, and a third fixing operation using the fastening member 42 and 43.

In the first fixing operation for such a mounting aspect shown in FIG. 19, the first fixing portion 10 is fixed to the wall surface 31. In the first temporary joining operation, the extension member Y is temporarily joined to the bracket X by the fastening member 44 that is passed through the hole H8 of the bracket X and is shallowly screwed into the extension member Y. In the second fixing operation, the extension member Y is fixed to the bracket X. In the second temporary joining operation, the supporting member 5 is temporarily joined to the extension member Y by the fastening member 42 that is passed through the hole H11 of the extension member Y and is shallowly screwed into the supporting member 5. In the third fixing operation, the supporting member 5 is fixed to the extension member Y.

Also, in the first unevenness adjustment after the temporary joining of joining the extension member Y to the bracket X, specifically, the position of the extension member Y temporarily joined to the second fixing portion 20 of the bracket X can be adjusted with respect to the bracket X in the first direction D1. In the second unevenness adjustment after the temporary joining of joining the supporting member 5 to the extension member Y, specifically, the position of the supporting member 5 temporarily joined to the extension member Y can be adjusted with respect to the extension member Y and the bracket X in the first direction D1. Therefore, by adjusting these fixation positions, it is possible to perform unevenness adjustment on the supporting member 5 with respect to the wall surface 31, as needed.

The above-described mounting of a fixation object (the supporting member 5 in the above-described example) using the bracket X and the extension member Y is suitable for performing unevenness adjustment on the fixation object. In addition to this, the above-described bracket X and the extension member Y that cooperate with each other when connecting the skeleton structure and the fixation object are suitable for improving their strengths in a building wall structure, and realizing a high degree of freedom in terms of the arrangement relationship with the fixation object.

The extension member Y, that is, the extension base portion 60 thereof has the holes H11 and H12, as described above. Such a configuration is suitable for eliminating or avoiding an operation for forming, in the extension member Y, a hole through which a fastening member is to be passed when constructing a wall structure, thereby achieving simplified and efficient construction operations.

Figure 20:
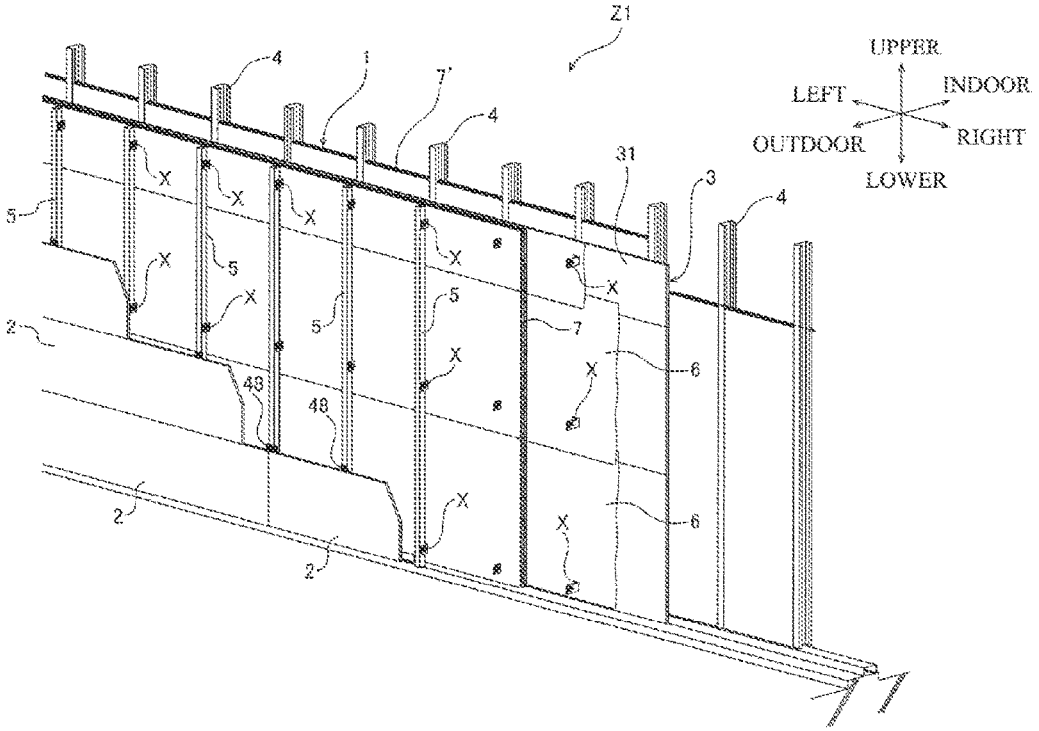
FIG. 20 is a perspective view (partially cut-off-perspective view) illustrating a building wall structure according to a second embodiment of the present invention.
Figure 21:
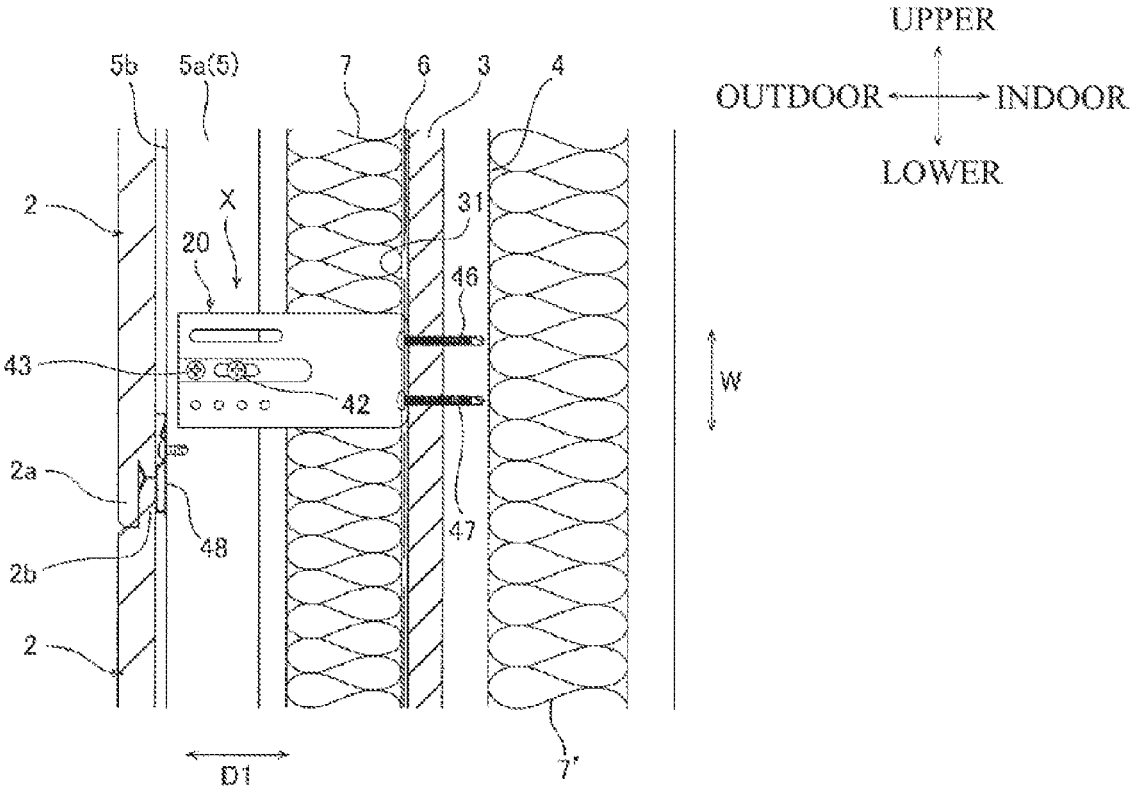
FIG. 21 is a partial cross-sectional view of the building wall structure shown in FIG. 20.
Figure 22:
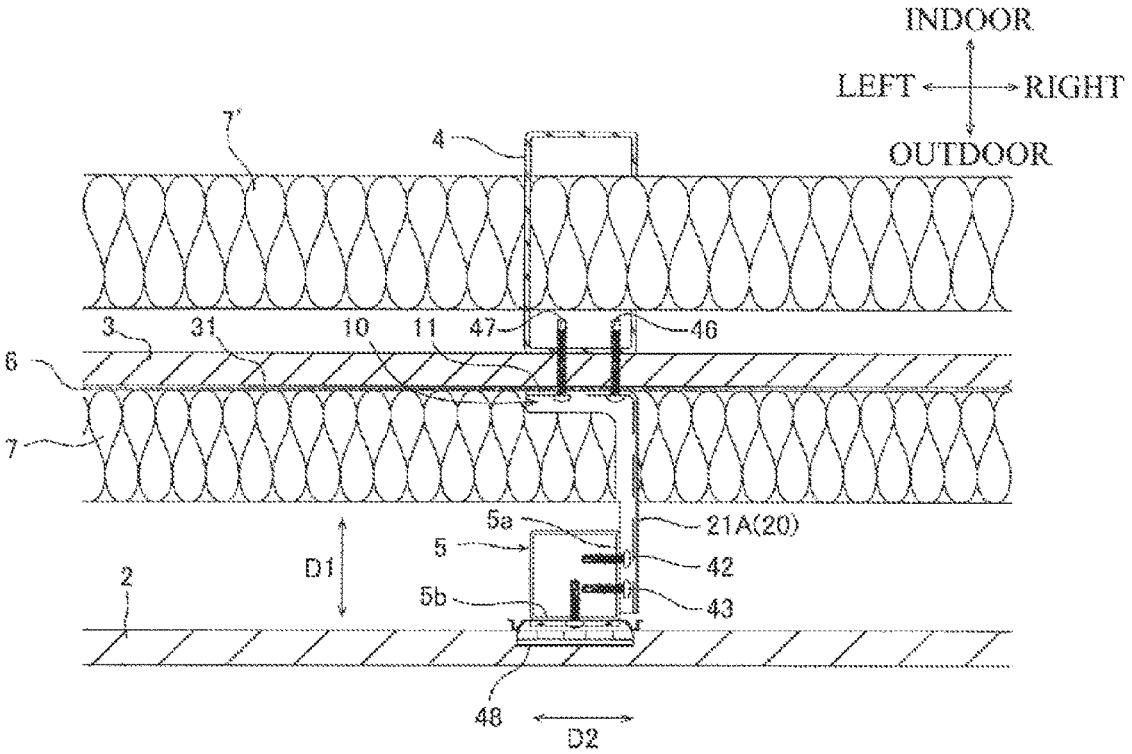
FIG. 22 is another partial cross-sectional view of the building wall structure shown in FIG. 20.

FIGS. 20 to 22 show a building wall structure Z1 according to a second embodiment of the present invention. FIG. 20 is a perspective view (partially cut-off-perspective view) illustrating the building wall structure Z1. FIG. 21 is a partial cross-sectional view of the bracket X and the vicinity thereof in the building wall structure Z1 when viewed from the right side. FIG. 22 is a partial cross-sectional view of the bracket X and the vicinity thereof in the building wall structure Z1 when viewed from the upper side. In FIG. 20, the vertically upward direction is indicated as "upper" and the vertically downward direction is indicated as "lower". Also, in FIG. 20, the horizontally leftward direction when viewed from the outdoor side to the indoor side is indicated as "left", and the horizontally rightward direction is indicated as "right". Also, in the drawings other than FIG. 20 where the vertical directions, the horizontal directions, and the outdoor-indoor directions are given, illustrations are given such that these directions correspond to those in FIG. 20.

The building wall structure Z1 is obtained by securing a plurality of exterior wall plates 2 to a building frame 1 (skeleton structure) constituting a building such as a house, a facility, or a warehouse. The building frame 1 may constitute a new building, or may constitute an existing building that is to be subjected to an exterior renovation work. In the present embodiment, the exterior wall plates 2 are plank members that have a high strength and a high rigidity in themselves and constitute the exterior wall of the building. The exterior wall plates 2 may be used in a new building, or may be used for renovation to cover a wall surface of an existing building and improve the design thereof. Also, the exterior wall plates 2 are an example of the plank members of the present invention. The plank members of the present invention are not limited to exterior wall plates, and may be, for example, decorative laminates that externally cover a building, structural panels for indoor use, interior planks, or the like.

In the present embodiment, the building frame 1 is a skeleton structure of steel construction (S construction), and is provided with a board member 3 that has a wall surface 31 on the superficial layer on the outdoor side. The board member 3 is, for example, a reinforced gypsum board. As the board member 3, a calcium silicate plate may be used. Steel stocks 4 are arranged on the indoor side of the board member 3. Examples of the steel stock 4 include a C steel pipe and a square steel pipe. In the present embodiment, a case where the steel stocks 4 are C steel pipes is shown as an example. On the other hand, a plurality of brackets X and a plurality of supporting members 5 are arranged on the outdoor side of the board member 3.

In the present embodiment, waterproof paper 6 and a heat insulation material 7 are provided between the board member 3 and the supporting members 5. The waterproof paper 6 is laid on the surface of the board member 3. The waterproof paper 6 may be omitted depending on the construction state or the like of the building frame 1. Examples of the heat insulation material 7 include a fibrous heat insulation material and a foamed plastic heat insulation material. Examples of the fibrous heat insulation material include rock wool and glass wool. Examples of the foamed plastic heat insulation material include foamed polyurethane, foamed phenol, and expanded polystyrene. A portion of the heat insulation material 7 that interferes with the brackets X is removed, and the heat insulation material 7 is arranged so that the brackets X are partially exposed. The heat insulation material 7 may be omitted depending on the construction state or the like of the building frame 1.

A heat insulation material 7' may be arranged on the indoor side of the board member 3. In the present embodiment, a case where the heat insulation material 7' is arranged on the indoor side of the board member 3 (for example, between the steel stocks 4) is shown as an example (depending on the construction state or the like of the building frame 1, the heat insulation material 7' may be omitted). Examples of the heat insulation material 7' include the above-described fibrous heat insulation material and the above-described foamed plastic heat insulation material.

A plurality of brackets X are arranged on the wall surface 31 while being spaced apart from each other at a predetermined distance in the vertical direction and the horizontal direction. As better shown in FIG. 22, the bracket X is arranged at a position at which it faces the steel stock 4 via the board member 3. In the present embodiment, each bracket X is secured to the board member 3, that is, the wall surface 31, and the steel stock 4 by the fastening members 46 and 47 (both corresponding to the first fastening members). The fastening members 46 and 47 are drill screws. Specifically, the surface 11 of the first fixing portion 10 of the bracket X is in contact with the wall surface 31, and the bracket X is fixed to the wall surface 31 by the fastening member 46 that is passed through, for example, the hole H2 (shown in FIG. 1, for example) of the first fixing portion 10 from the surface 12 side (opposite to the surface 11) and reaches the wall surface 31, and the fastening member 47 that is passed through, for example, the hole H5 (shown in FIG. 1, for example) of the first fixing portion 10 from the surface 12 side and reaches the wall surface 31.

The plurality of supporting members 5 are arranged while being spaced apart from each other at a predetermined distance in the horizontal direction and extending along the wall surface 31 in the vertical direction. Each supporting member 5 is arranged extending across at least two brackets X. In the present embodiment, the supporting members 5 are steel furring strips (vertical furring strips) in the shape of a hollow square material. Instead of such a configuration, wooden supporting members may also be used as the supporting members 5. Also, each supporting member 5 includes a first joining portion 5*a* that is fixed to a bracket X, and a second joining portion 5*b* that is connected to the side of the first joining portion 5*a* opposite to the wall surface 31.

As shown in FIGS. 21 and 22, in the present embodiment, the bracket X and the supporting member 5 are mounted to the wall surface 31 in the same manner as described with reference to FIG. 11, except for the fastening members 46 and 47 being used instead of the fastening member 41 to fix the bracket X to the wall surface 31. That is to say, in the present embodiment, the first joining portion 5*a* of the supporting member 5 is in contact with the surface 22A of the rib portion 22 of the second fixing portion 20 of the bracket X, as well as the first wall portion 23*a* and the second wall portion 24*a*, and the bracket X and the supporting member 5 are fastened and fixed to each other by the fastening members 42 and 43 that are passed through the rib portion 22 from the side opposite to the surface 22A and reach the first joining portion 5*a*.

In the mounting aspect shown in FIG. 22, the bracket X is fixed to the board member 3, that is, the wall surface 31, and the steel stock 4, and the steel stock 4, the bracket X, and the supporting member 5 are aligned with each other in a direction perpendicular to the wall surface 31. Such a configuration is more suitable for stably supporting the exterior wall plate 2 in the building wall structure Z1 than in the mounting aspect shown in, for example, FIG. 10.

Also, as described with reference to FIG. 17, an extension member Y together with the bracket X can be used in mounting the supporting member 5 using the bracket X in the building wall structure Z1.

At at least one of a plurality of fixation positions at which the plurality of supporting members 5 are fixed to the plurality of brackets X, the bracket X and the supporting member 5 may be mounted to the wall surface 31 in the same manner as described with reference to FIG. 10, except for the fastening members 46 and 47 being used instead of the fastening member 41 to fix the bracket X to the wall surface 31. That is to say, in the present embodiment, the first joining portion 5*a* of the supporting member 5 is brought into contact with the surface 21A of the base portion 21 of the second fixing portion 20 of the bracket X, and the bracket X and the supporting member 5 are fastened and fixed to each other by the fastening members 42 and 43 that are passed through the base portion 21 from the side opposite to the surface 21A and reach the first joining portion 5*a*. In this case, as described with reference to FIG. 16, the extension member Y together with the bracket X can be used in mounting the supporting member 5 using the bracket X.

The exterior wall plates 2 are, for example, plank members that are elongated in the horizontal direction and have a substantially rectangular shape. A ceramic material including cement may be used as an example of the constituent material of the exterior wall plate 2. Instead, the exterior wall plates 2 may be metal plank members, wooden plank members, or resin plank members. Also, the exterior wall plates 2 may have, for example, exterior surfaces patterned with brick-like structures.

As shown in, for example, FIG. 21, in the building wall structure Z1, edge portions of each exterior wall plate 2 in the vertical direction have an upper rabbet structure 2*a* and a lower rabbet structure 2*b* for shiplap joint between the exterior wall plates 2 adjacent to each other in the vertical direction. Alternatively, edge portions of each exterior wall plate 2 in the horizontal direction may have an upper rabbet structure and a lower rabbet structure for shiplap joint between the exterior wall plates 2 adjacent to each other in the horizontal direction, and such exterior wall plates 2 may be joined to each other in a shiplap manner in the horizontal direction. Alternatively, a configuration is also possible in which edge portions, in the horizontal direction, of the exterior wall plates 2 that are adjacent to each other in the horizontal direction do not have an upper rabbet structure and a lower rabbet structure, and are joined to each other via a so-called hat joiner or a ceiling.

Such an exterior wall plate 2 may be secured to the second joining portion 5*b* of the supporting member 5 by a fastening method using drill screws, or by a predetermined securing member secured to the second joining portion 5*b*. FIGS. 20 to 22 show a securing member 48 for use in the securing, as an example.

In the building wall structure Z1 having the above-described configuration, the above-described brackets X are used. According to the building wall structure Z1, thus, the brackets X included therein achieve the same technical effects as those described regarding the bracket X.

Figure 23:
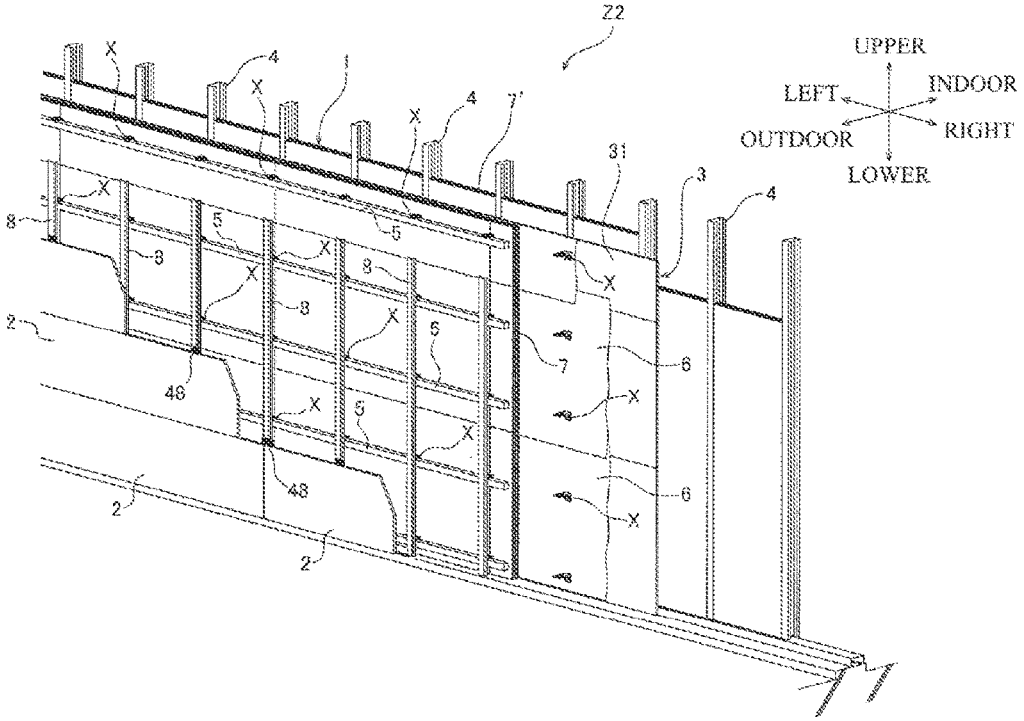
FIG. 23 is a perspective view (partially cut-off-perspective view) illustrating a building wall structure according to a third embodiment of the present invention.
Figure 24:
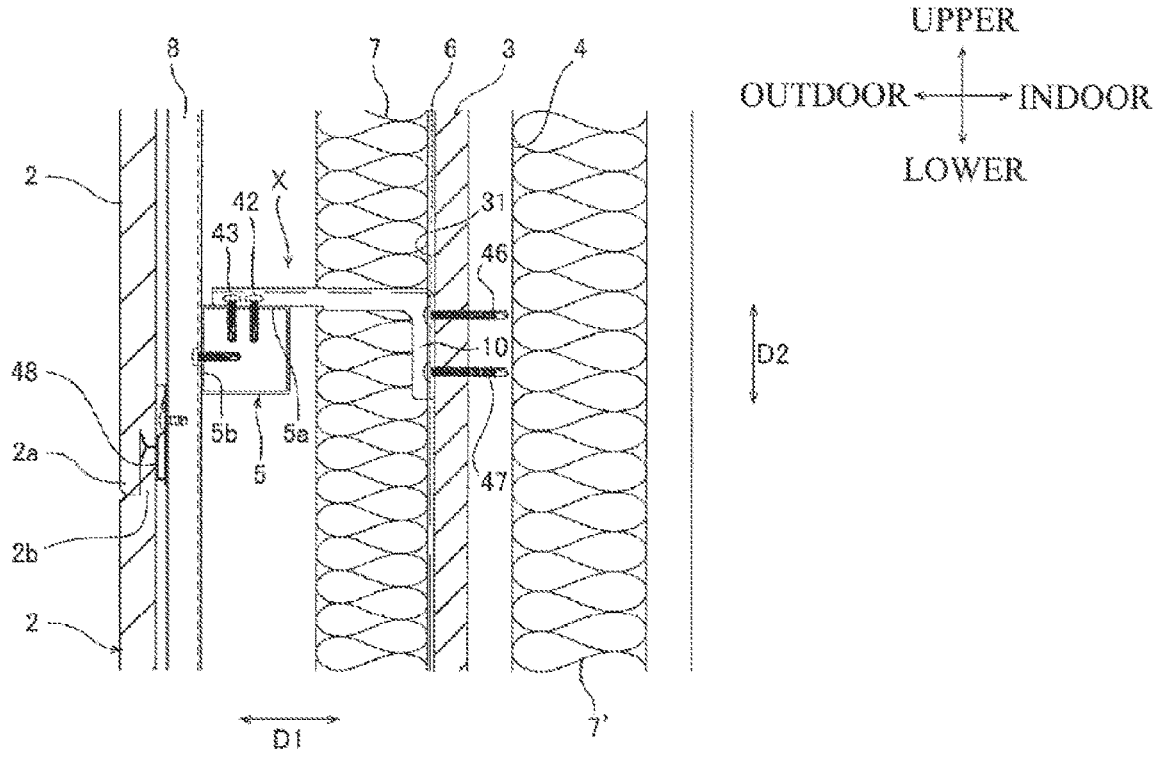
FIG. 24 is a partial cross-sectional view of the building wall structure shown in FIG. 23.
Figure 25:
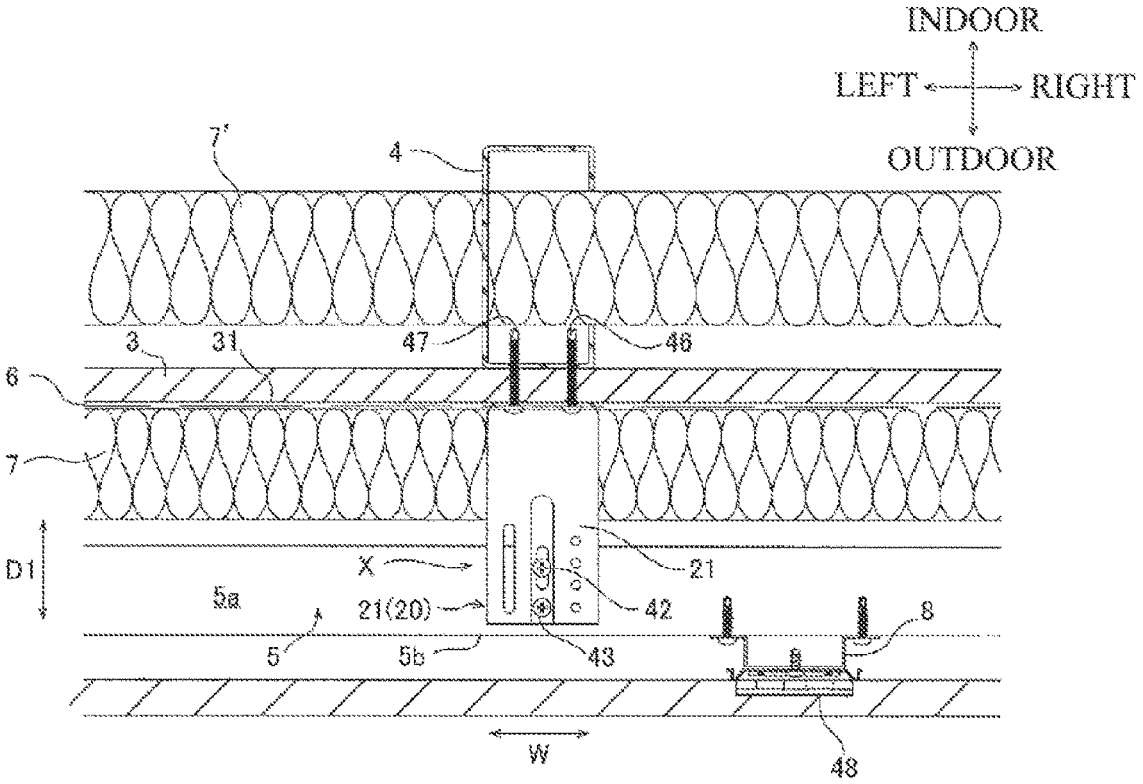
FIG. 25 is another partial cross-sectional view of the building wall structure shown in FIG. 23.

FIGS. 23 to 25 show a building wall structure Z2 according to a third embodiment of the present invention. FIG. 23 is a perspective view (partially cut-off perspective view) illustrating the building wall structure Z2. FIG. 24 is a partial cross-sectional view of the bracket X and the vicinity thereof in the building wall structure Z2 when viewed from the right side. FIG. 25 is a partial cross-sectional view of the bracket X and the vicinity thereof in the building wall structure Z2 when viewed from the upper side. The building wall structure Z2 differs from the above-described building wall structure Z1 in that the bracket X is secured to the wall surface 31 in a different orientation, the supporting member 5 fixed to the bracket X is mounted as a lateral supporting member, and an additional supporting member 8 is provided as a vertical supporting member.

A plurality of brackets X are arranged on the wall surface 31 while being spaced apart from each other at a predetermined distance in the vertical direction and the horizontal direction. As better shown in FIG. 25, the bracket X is arranged at a position at which it faces the steel stock 4 via the board member 3.

A plurality of supporting members 5 according to the present embodiment are arranged while being spaced apart from each other at a predetermined distance in the vertical direction and extending along the wall surface 31 in the horizontal direction. Each supporting member 5 is arranged extending across at least two brackets X. In the present embodiment, the supporting members 5 are steel furring strips (lateral furring strips) in the shape of a hollow square material. Instead of such a configuration, wooden supporting members 5 or supporting members with an L-shaped transverse cross section may also be used as the supporting members 5. Also, each supporting member 5 includes a first joining portion 5*a* that is fixed to a bracket X, and a second joining portion 5*b* that is connected to the side of the first joining portion 5*a* opposite to the wall surface 31.

As shown in FIGS. 24 and 25, in the present embodiment, the bracket X and the supporting member 5 are mounted to the wall surface 31 in the same manner as described with reference to FIG. 13, except for the fastening members 46 and 47 being used instead of the fastening member 41 to fix the bracket X to the wall surface 31. That is to say, in the present embodiment, the first joining portion 5*a* of the supporting member 5 is in contact with the surface 22A of the rib portion 22 of the second fixing portion 20 of the bracket X, as well as the first wall portion 23*a* and the second wall portion 24*a*, and the bracket X and the supporting member 5 are fastened and fixed to each other by the fastening members 42 and 43 that are passed through the rib portion 22 from the side opposite to the surface 22A and reach the first joining portion 5*a*. Also, as described with reference to, for example, FIG. 18, an extension member Y together with the bracket X can be used in mounting the supporting member 5 using the bracket X.

At at least one of a plurality of fixation positions at which the plurality of supporting members 5 are fixed to the plurality of brackets X, the bracket X and the supporting member 5 may be mounted to the wall surface 31 in the same manner as described with reference to FIG. 12, except for the fastening members 46 and 47 being used instead of the fastening member 41 to fix the bracket X to the wall surface 31. That is to say, in the present embodiment, the first joining portion 5*a* of the supporting member 5 is in contact with the surface 21A of the base portion 21 of the second fixing portion 20 of the bracket X, and the bracket X and the supporting member 5 are fastened to each other by the fastening members 42 and 43 that are passed through the base portion 21 from the side opposite to the surface 21A and reach the first joining portion 5*a*. In this case, as described with reference to, for example, FIG. 19, an extension member Y together with the bracket X can be used in mounting the supporting member 5 using the bracket X.

A plurality of additional supporting members 8 are arranged while being spaced apart from each other at a predetermined distance in the left-right direction (horizontal direction), and extending along the wall surface 31 in the vertical direction. Each additional supporting member 8 is arranged extending across at least two supporting members 5, and is fastened to the supporting members 5 with predetermined screws, for example. In the present embodiment, the additional supporting members 8 are elongated plank members, and has a hat shape in a transverse cross section.

In the present embodiment, such an exterior wall plate 2 may be secured to the additional supporting member 8 by fastening using drill screws, or by a predetermined securing member. FIGS. 23 to 25 show a securing member 48 for use in the securing, as an example.

In the building wall structure Z2 having the above-described configuration, the above-described brackets X are used. According to the building wall structure Z2, thus, the brackets X included therein achieve the same technical effects as those described regarding the bracket X.

As described above, the building wall structure Z2 further includes the plurality of additional supporting members 8 each arranged extending across at least two supporting members 5. The additional supporting members 8 are secured to the second joining portions 5*b* of the at least two supporting members 5, and the exterior wall plates 2 (plank members) are secured to the additional supporting members 8. Such a configuration is suitable for a case where a plurality of additional supporting members 8 are arranged at a pitch different from the pitch at which the brackets X are arranged (pitch in the horizontal direction in the present embodiment) and the exterior wall plates 2 are secured to the additional supporting members 8, and is thus suitable for supporting more stably the exterior wall plates 2.

The methods for constructing the above-described building wall structures Z1 and Z2 each includes a first process, a second process, and a third process as follows.

In the first process, a plurality of brackets X are secured to the wall surface 31. In the first process, the surfaces 11 of the first fixing portions 10 of the brackets X are brought into contact with the wall surface 31 so that the brackets X are fastened to the wall surface 31 by predetermined fastening members (first fastening members) that are passed through the first fixing portion 10 from the side opposite to the surface 11 and reach the wall surface 31.

In the second process, each supporting member 5 is fixed to at least two brackets X secured to the wall surface 31. The supporting member 5 includes the first joining portion 5*a* that is fixed to the brackets X, and the second joining portion 5*b* that is connected to the side of the first joining portion 5*a* opposite to the wall surface 31.

In the second process, specifically, the first joining portion 5*a* of the supporting member 5 is brought into contact with the surfaces 12 of the base portions of the second fixing portions 20 of the brackets X, and the brackets X and the supporting member 5 are fastened to each other by predetermined fastening members (second fastening members) that are passed through the base portions from the side opposite to the surfaces 12 and reach the first joining portion 5*a*. Alternatively, in the second process, the first joining portion 5*a* of the supporting member 5 is brought into contact with the surfaces 22A of the rib portions 22 of the second fixing portions 20 of the brackets X, as well as the first wall portions 23*a* and the second wall portions 24*a*, and the brackets X and the supporting member 5 are fastened to each other by fastening members (second fastening members) that are passed through the rib portions 22 from side opposite to the surfaces 22A and reach the first joining portion 5*a*.

In the third process, the exterior wall plates 2 are directly or indirectly secured to the supporting members 5.

In such a construction method, the above-described brackets X are used. According to this construction method, thus, the same technical effects as those described regarding the bracket X can be realized.

The building frame 1 may be of reinforced concrete construction (RC construction), instead of S construction. If the building frame 1 is of RC construction, the wall surface 31 of the skeleton structure is made of mortar, and the brackets X are fastened to such a wall surface 31 by anchor bolts serving as fastening members.

LIST OF REFERENCE NUMERALS

X Bracket
D1 First direction
D2 Second direction
W Width direction
10 First fixing portion
20 Second fixing portion
11 Surface (first surface)
12 Surface
13 Third side-wall portion
14 Fourth side-wall portion
21 Base portion
21A Surface (second surface)
21B Surface
22 Rib portion
22A Surface (third surface)
23 First side-wall portion
23*a* First wall portion
23*b* First high wall portion
24 Second side-wall portion
24*a* Second wall portion
24*b* Second high wall portion
L Reference line
H1 to H12 Hole
Y Extension member
60 Extension base portion
60A Surface (fourth surface)
60B Surface (fifth surface)
61 First extension side-wall portion
62 Second extension side-wall portion
Z1, Z2 Building wall structure
1 Building frame
2 Exterior wall plate
5 First supporting member
8 Second supporting member
5*a* First joining portion
5*b* Second joining portion
41, 46, 47 Fastening member (first fastening member)
42, 43 Fastening member (second fastening member)
44, 45 Fastening member (third fastening member)

The invention claimed is:

1. An architectural bracket comprising:

a first fixing portion that includes a first surface for coming into contact with a building frame; and a second fixing portion that extends from an end of the first fixing portion to a side opposite to the first surface, so as to intersect with the first fixing portion, wherein the second fixing portion includes:

a base portion that includes a second surface for coming into contact with a member;

a rib portion that protrudes from the base portion to a side opposite to the second surface, and includes, at a protruding end of the rib portion, a third surface for coming into contact with a member, wherein the third surface is flat;

a first side-wall portion that protrudes from an end of the base portion in a width direction that intersects with a direction in which the second fixing portion extends, to the same side as the side to which the rib portion protrudes, the first side-wall portion including a first wall portion for coming into contact with a member arranged in parallel to the rib portion in the width direction; and a second side-wall portion that protrudes from the other end of the base portion in the width direction of the base portion, to the same side as the side to which the rib portion protrudes, the second side-wall portion including a second wall portion for coming into contact with a member arranged in parallel to the rib portion in the width direction, wherein a protrusion height of the third surface is equal to at least one of a protrusion height of the first wall portion and a protrusion height of the second wall portion.

2. The architectural bracket according to claim 1, wherein the first fixing portion includes: a third side-wall portion that protrudes from an end of the first fixing portion in the width direction, to the same side as the side to which the second fixing portion protrudes; and a fourth side-wall portion that protrudes from the other end of the first fixing portion in the width direction, to the same side as the side to which the second fixing portion protrudes, and the first side-wall portion and the third side-wall portion are connected to each other, and the second side-wall portion and the fourth side-wall portion are connected to each other.

3. The architectural bracket according to claim 1, wherein the first side-wall portion includes, on the first fixing portion side relative to the first wall portion, a first high wall portion that is higher than the first wall portion, and the second side-wall portion includes, on the first fixing portion side relative to the second wall portion, a second high wall portion that is higher than the second wall portion.

4. The architectural bracket according to claim 1, wherein the base portion has at least one hole through which a fastening member is to be passed.

5. The architectural bracket according to claim 1, wherein the rib portion has at least one hole through which a fastening member is to be passed.

6. The architectural bracket according to claim 4, wherein the hole includes an elongated hole that extends in the direction in which the second fixing portion extends.

7. The architectural bracket according to claim 1, wherein the first fixing portion has at least one hole through which a fastening member is to be passed.

8. The architectural bracket according to claim 7, wherein the hole includes a first hole, and at least one second hole that is located in a surrounding area of the first hole and is smaller than the first hole.

9. The architectural bracket according to claim 1, wherein a surface of the first fixing portion that is opposite to the first surface has a reference line for use in positioning.

10. A building wall structure comprising:

a building frame that includes a wall surface;

a plurality of architectural brackets arranged on the wall surface;

a plurality of supporting members each arranged extending across at least two architectural brackets;

a plurality of first fastening members;

a plurality of second fastening members; and a plurality of plank members for covering the wall surface, wherein each of the architectural brackets is the architectural bracket according to claim 1, the first surfaces of the first fixing portions of the architectural brackets are in contact with the wall surface, and the architectural brackets and the wall surface are fastened to each other by the first fastening members that are passed through the first fixing portions from a side opposite to the first surfaces and reach the wall surface, wherein each of the supporting members includes a first joining portion that is fixed to the architectural brackets, and a second joining portion that is connected to a side of the first joining portion that is opposite to the wall surface, and at at least one of a plurality of fixation positions at which the plurality of supporting members are fixed to the plurality of architectural brackets, the first joining portion of the supporting member is in contact with the second surfaces of the base portions of the second fixing portions of the architectural brackets, and the architectural brackets and the supporting member are fastened to each other by the second fastening members that are passed through the base portions from a side opposite to the second surfaces and reach the first joining portion, or the first joining portion of the supporting member is in contact with the third surfaces of the rib portions of the second fixing portions of the architectural brackets, as well as the first wall portions and the second wall portions, and the architectural brackets and the supporting member are fastened to each other by the second fastening members that are passed through the rib portions from a side opposite to the third surfaces and reach the first joining portion, and wherein the plank members are directly or indirectly secured to the second joining portions of the supporting members.

11. A building wall structure comprising:

a building frame that includes a wall surface;

a plurality of architectural brackets arranged on the wall surface;

a plurality of supporting members each arranged extending across at least two architectural brackets;

a plurality of first fastening members;

a plurality of second fastening members; and a plurality of plank members for covering the wall surface, wherein each of the architectural brackets is the architectural bracket according to claim 1, wherein the first surfaces of the first fixing portions of the architectural brackets are in contact with the wall surface, and the architectural brackets and the wall surface are fastened to each other by the first fastening members that are passed through the first fixing portions from a side opposite to the first surfaces and reach the wall surface, wherein each of the supporting members includes a first joining portion and a second joining portion, and wherein at least one of a plurality of fixation positions at which the plurality of supporting members are fixed to the plurality of architectural brackets, the building wall structure further comprising:

an extension member; and a third fastening member, wherein the extension member includes:

an extension base portion that includes a fourth surface for coming into contact with the second surface or the third surface of the base portion of the architectural bracket, and a fifth surface for coming into contact with a member located opposite to the fourth surface, the extension base portion extending along the second fixing portion, a first extension side-wall portion that protrudes from an end of the extension base portion in a width direction that intersects with an extension direction in which the extension base portion extends, to the fourth surface side in a thickness direction of the extension base portion; and a second extension side-wall portion that protrudes from the other end of the extension base portion in the width direction that intersects with the extension direction of the extension base portion, to the same side as the side to which the first extension side-wall portion protrudes, wherein the second fixing portion of the architectural bracket is fit between the first extension side-wall portion and the second extension side-wall portion of the extension member, and the extension member extends further to a side opposite to the first fixing portion relative to the second fixing portion of the architectural bracket in the extension direction, and wherein at a fixation position at which the supporting member is fixed to the architectural bracket, and wherein the fourth surface of the extension member is in contact with the second surface of the base portion of the second fixing portion of the architectural bracket, the architectural bracket and the supporting member are fastened to each other by the third fastening member that is passed through the base portion from a side opposite to the second surface and reaches the extension base portion, the first joining portion of the supporting member is in contact with the fifth surface of the extension member, and the extension member and the supporting member are fastened to each other by the second fastening member that is passed through the extension member from the fourth surface side and reaches the first joining portion, or the fourth surface of the extension member is in contact with the third surface of the rib portion of the second fixing portion of the architectural bracket, the architectural bracket and the extension member are fastened to each other by the third fastening member that is passed through the rib portion from a side opposite to the third surface and reaches the extension base portion, the first joining portion of the supporting member is in contact with the fifth surface of the extension member, and the extension member and the supporting member are fastened to each other by the second fastening member that is passed through the extension member from the fourth surface side and reaches the first joining portion.

12. The building wall structure according to claim 11, wherein the extension base portion includes: at least one elongated hole through which a fastening member is to be passed, and that extends in the extension direction of the extension base portion; and at least one hole through which a fastening member is to be passed, and that is spaced apart from the elongated hole in the width direction.

13. The building wall structure according to claim 10, further comprising a plurality of additional supporting members each arranged extending across at least two supporting members, wherein each of the additional supporting members is secured to the second joining portions of the at least two supporting members, and the plank members are secured to the additional supporting members.

14. A plank member construction method for securing a plank member to a building frame including a wall surface, the method comprising:

a first process of securing a plurality of the architectural brackets to the wall surface;

a second process of fixing a supporting member to at least two of the architectural brackets secured to the wall surface; and a third process of directly or indirectly securing a plank member to the supporting member, wherein each of the architectural brackets is the architectural bracket according to claim 1, in the first process, the first surfaces of the first fixing portions of the architectural brackets are brought into contact with the wall surface, and the architectural brackets and the wall surface are fastened to each other by first fastening members that are passed through the first fixing portions from a side opposite to the first surfaces and reach the wall surface, the supporting member includes a first joining portion that is fixed to the architectural brackets, and a second joining portion that is connected to a side of the first joining portion that is opposite to the wall surface, and in the second process, the first joining portion of the supporting member is brought into contact with the second surfaces of the base portions of the second fixing portions of the architectural brackets, and the architectural brackets and the supporting member are fastened to each other by second fastening members that are passed through the base portions from a side opposite to the second surfaces and reach the first joining portion, or the first joining portion of the supporting member is brought into contact with the third surfaces of the rib portions of the second fixing portions of the architectural brackets, as well as the first wall portions and the second wall portions, and the architectural brackets and the supporting member are fastened to each other by the second fastening members that are passed through the rib portions from a side opposite to the third surfaces and reach the first joining portion.

* * * * *